US007769193B2

(12) United States Patent
Matsuzawa

(10) Patent No.: US 7,769,193 B2
(45) Date of Patent: Aug. 3, 2010

(54) ELECTROSTATIC ULTRASONIC TRANSDUCER, ULTRASONIC SPEAKER, AUDIO SIGNAL REPRODUCTION METHOD, ELECTRODE MANUFACTURING METHOD FOR USE IN ULTRASONIC TRANSDUCER, ULTRASONIC TRANSDUCER MANUFACTURING METHOD, SUPERDIRECTIVE ACOUSTIC SYSTEM, AND DISPLAY DEVICE

(75) Inventor: Kinya Matsuzawa, Shiojiri (JP)

(73) Assignee: Seiko Epson Corporation (JP)

( * ) Notice: Subject to any disclaimer, the term of this patent is extended or adjusted under 35 U.S.C. 154(b) by 1042 days.

(21) Appl. No.: 11/459,986

(22) Filed: Jul. 26, 2006

(65) Prior Publication Data

US 2007/0029899 A1 Feb. 8, 2007

(30) Foreign Application Priority Data

Aug. 3, 2005 (JP) ..... 2005-225068
Jun. 13, 2006 (JP) ..... 2006-163241

(51) Int. Cl.
*H04R 25/00* (2006.01)

(52) U.S. Cl. ..... 381/191; 381/111

(58) Field of Classification Search ..... 381/190, 381/191, 150, 77, 111, 354, 174, 175, 369, 381/163; 310/334, 309, 316.01; 367/181, 367/137, 170; 307/400
See application file for complete search history.

(56) References Cited

U.S. PATENT DOCUMENTS 6,775,388 B1 8/2004 Pompei
7,355,322 B2 * 4/2008 Miyazaki ..... 310/316.01
7,376,236 B1 * 5/2008 Norris et al. ..... 381/111
7,382,688 B2 * 6/2008 Miyazaki et al. ..... 367/137
7,668,323 B2 * 2/2010 Miyazaki ..... 381/190
2004/0052387 A1 * 3/2004 Norris et al. ..... 381/190
2005/0149338 A1 * 7/2005 Fukui ..... 704/278
2006/0233404 A1 * 10/2006 Croft et al. ..... 381/191
2006/0291667 A1 * 12/2006 Watanabe et al. ..... 381/77

FOREIGN PATENT DOCUMENTS

JP 2000-50387 2/2000
JP 2000-50392 2/2000
JP 2007-060337 3/2007
JP 2007-82052 3/2007
JP 2007-104521 4/2007
JP 2007-228472 9/2007

* cited by examiner

*Primary Examiner*—Curtis Kuntz
*Assistant Examiner*—Hai Phan
(74) *Attorney, Agent, or Firm*—Harness, Dickey & Pierce, P.L.C.

(57) ABSTRACT

An electrostatic ultrasonic transducer that includes: a first electrode that is formed with a plurality of holes; a second electrode that is formed with a plurality of holes, and is used in pair with the first electrode; an oscillation film formed with a conductor layer that is sandwiched between the pair of electrodes, and the conductor layer is applied with a direct-current (DC) bias voltage; and a retention member that keeps hold of the pair of electrodes and the oscillation film. In the transducer, an alternating signal is applied between the pair of electrodes, and the pair of electrodes each have a thickness t of about $(\lambda/4)\cdot n$ (where $\lambda$ denotes a wavelength of ultrasound, and n denotes a positive odd number).

18 Claims, 15 Drawing Sheets

TWO-SIDED ELECTRODE EVAPORATION FILM

CONFIGURATION IN WHICH ELECTRODE LAYER IS SANDWICHED BY INSULATOR POLYMER FILMS

CONFIGURATION IN WHICH TWO ONE-SIDED ELECTRODE FILMS ARE ATTACHED TOGETHER TO MAKE ELECTRODE SURFACE ABUT THERETO

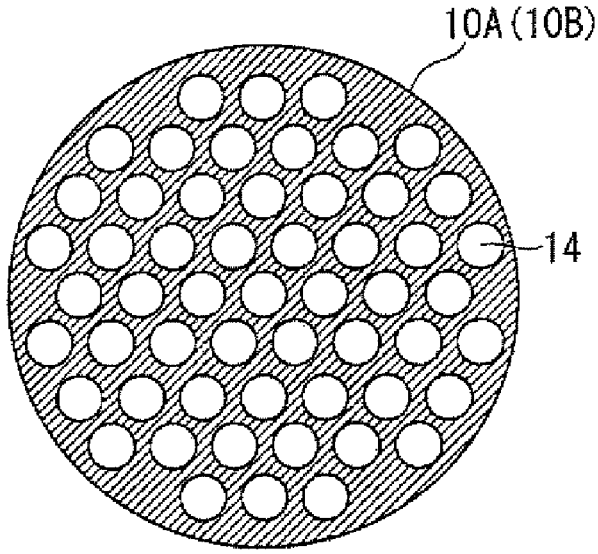
FIG. 5
FIG.6A
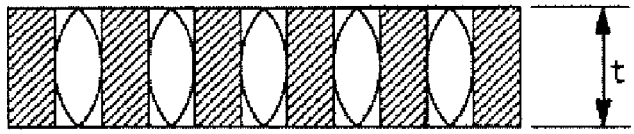
ACOUSTIC TUBE AND ACOUSTIC WAVE WHEN SOUND PRESSURE IS MINIMUM AT EXIT PORT
FIG.6B
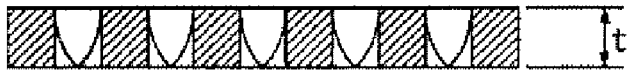
ACOUSTIC TUBE AND ACOUSTIC WAVE WHEN SOUND PRESSURE IS MAXIMUM AT EXIT PORT CASE WITH t2 = 10 μm

| D1 (mm) | t1 (μm) | | |
|---|---|---|---|
| | 6 | 9 | 12 |
| 0. 7 | 0. 51 | 0. 62 | 0. 69 |
| 0. 9 | 0. 53 | 0. 63 | 0. 71 |
| 1. 1 | 0. 54 | 0. 65 | 0. 72 |
| 1. 5 | 0. 57 | 0. 68 | 0. 74 |

CASE WITH t2 = 20 μm

| D1 (mm) | t1 (μm) | | |
|---|---|---|---|
| | 6 | 9 | 12 |
| 0. 7 | 0. 33 | 0. 43 | 0. 51 |
| 0. 9 | 0. 34 | 0. 45 | 0. 53 |
| 1. 1 | 0. 36 | 0. 46 | 0. 54 |
| 1. 5 | 0. 38 | 0. 49 | 0. 57 |

ELECTROSTATIC ULTRASONIC TRANSDUCER, ULTRASONIC SPEAKER, AUDIO SIGNAL REPRODUCTION METHOD, ELECTRODE MANUFACTURING METHOD FOR USE IN ULTRASONIC TRANSDUCER, ULTRASONIC TRANSDUCER MANUFACTURING METHOD, SUPERDIRECTIVE ACOUSTIC SYSTEM, AND DISPLAY DEVICE

BACKGROUND

1. Technical Field

The present invention relates to an electrostatic ultrasonic transducer that generates a high sound pressure of a fixed level over a wide range of frequency, an ultrasonic speaker using the same and an audio signal reproduction method using the electrostatic ultrasonic transducer, an electrode manufacturing method for use in an ultrasonic transducer, an ultrasonic transducer manufacturing method, a superdirective acoustic system, and a display device.

2. Related Art

Most of the previous ultrasonic transducers are of resonance type using a piezoelectric ceramic material.

FIG. 16 shows the configuration of the previous ultrasonic transducer. Most of the previous ultrasonic transducers are of resonance type using a piezoelectric ceramic material for an oscillator. Using the piezoelectric ceramic material for an oscillator, the ultrasonic transducer of FIG. 16 performs conversion from an electric signal to ultrasound and from ultrasound to an electric signal, i.e., performs transmission and reception of ultrasound. The ultrasonic transducer of FIG. 16 is of bimorph type, and is configured to include: two piezoelectric ceramic plates 61 and 62, a cone 63, a case 64, leads 65 and 66, and a screen 67.

The piezoelectric ceramic plates 61 and 62 are affixed together, and the leads 65 and 66 are respectively connected to their surfaces opposite to the affixed surfaces.

The ultrasonic transducer of resonance type makes use of a resonance phenomenon observed in the piezoelectric ceramic plates so that the characteristics in terms of ultrasound transmission and reception are increased in a relatively narrow range of frequency of a level closer to the resonance frequency.

Unlike such an ultrasonic transducer of resonance type shown in FIG. 16, the previous ultrasonic transducer of electrostatic type is known as an ultrasonic transducer of broadband oscillation type with which a high sound pressure can be generated over a wide range of frequency. Such an electrostatic ultrasonic transducer is referred to as of Pull type because the oscillation film moves only in the direction toward the side of a fixed electrode. FIG. 17 shows the specific configuration of such an ultrasonic transducer of broadband oscillation type (Pull type).

The electrostatic ultrasonic transducer of FIG. 17 is using a dielectric 131 (insulator) as an oscillator. The dielectric 131 is made of PET (polyethylene terephthalate resin) or others with a thickness of about 3 to 10 μm. On the upper surface portion of the dielectric 131, an upper electrode 132 is formed as a piece therewith by evaporation or others. The upper electrode 132 is formed as a metal leaf, e.g., aluminum leaf. A lower electrode 133 made of brass is so provided as to come in contact with the lower surface portion of the dielectric 131. The lower electrode 133 is connected with a lead 152 and is fixed to a base plate 135 made of Bakelite or others.

The upper electrode 132 is connected with a lead 153, which is connected to a direct-current (DC) bias power supply 150. The DC bias power supply 150 serves to always apply a DC bias voltage to the upper electrode 132. The DC bias voltage is of about 50 to 150V for absorbing the upper electrode so that the upper electrode 132 is absorbed to the side of the lower electrode 133. A reference numeral 151 denotes a signal source.

The components of the dielectric 131, the upper electrode 132, and the base plate 135 are swaged by a case 130 together with a metal rings 136, 137, and 13S, and a mesh 139.

The surface of the lower electrode 133 on the side of the dielectric 131 is formed with a plurality of small randomly-shaped grooves of about several tens to hundreds of micrometers (μm). These small grooves each serve as a gap between the lower electrode 133 and the dielectric 131 so that a small change is observed thereby in the distribution of the capacitance between the upper and lower electrodes 132 and 133.

These randomly-shaped small grooves are formed by manually filing the surface of the lower electrode 133 to make it rough. By forming such an unlimited number of capacitors varying in gap size and depth, in the ultrasonic transducer of electrostatic type, the frequency response of the ultrasonic transducer of FIG. 17 covers a wide range of frequency as indicated by a curve Q1 of FIG. 18.

With the ultrasonic transducer of the configuration as above, a square wave signal (50 to 150 Vp-p) is applied between the upper and lower electrodes 132 and 133 in the state that the upper electrode 132 is being applied with the DC bias voltage. For information, as indicated by a curve Q2 of FIG. 18, the frequency response of an ultrasonic transducer of resonance type is −30 dB with respect to the maximum sound pressure with an assumption that the central frequency, i.e., resonance frequency of the piezoelectric ceramic plate, is, for example, 40 kHz, and covers the frequency of ±5 kHz with respect to the central frequency leading to the maximum sound pressure.

As to the ultrasonic transducer of broadband oscillation type configured as above, the frequency response thereof is flat in a range from 40 kHz to 100 kHz or so, and is about ±6 dB with 100 kHz compared with the maximum sound pressure. For details, refer to Patent Document 1 (JP-A-2000-50387), and Patent Document 2 (JP-A-2000-50392).

As described above, unlike the ultrasonic transducer of resonance type shown in FIG. 16, the ultrasonic transducer of electrostatic type shown in FIG. 17 is previously known as an ultrasonic transducer of broadband oscillation type (Pull type) with which a relatively high sound pressure can be generated over a wide range of frequency. The problem with such an electrostatic ultrasonic transducer is that, as shown in FIG. 18, the maximum sound pressure is low as 120 dB or lower compared with the sound pressure of 130 dB or higher for the ultrasonic transducer of resonance type. The sound pressure is thus somewhat not enough for use as an ultrasonic speaker.

A description is now given for the ultrasonic speaker. In the ultrasonic speaker, a signal in an ultrasonic frequency band called carrier wave is subjected to AM (amplitude) modulation using an audio signal, i.e., signal in an audio frequency band. The resulting modulation signal is used to drive the ultrasonic transducer, whereby the acoustic wave is emitted into the air. The acoustic wave is in the state that the ultrasound is modulated by an audio signal from a signal source. With such acoustic wave emission, the original audio signal is self-reproduced in the air due to the nonlinearity of the air.

That is, because the acoustic wave is a compressional wave being transmitted with a medium of air, in the course of transmission, the modulated ultrasound is affected by the apparent difference of air density, i.e., the air is dense in some portion, and not in dense in other portions. This causes an increase of the speed of sound in the air-dense portion, and a decrease in the no-air-dense portion. As a result, the modulation wave itself suffers from distortion, and is subjected to curve fitting to derive a carrier wave (ultrasound) and an audible wave (original audio signal). As such, we human beings can hear only the audible sound of 20 kHz or lower, i.e., only the original audio signal, and such a principle is generally referred to as the parametric array effects.

To maximize the parametric array effects, the ultrasound pressure of 120 dB or higher is required. The electrostatic ultrasonic transducer, however, has a difficulty in achieving this value, and thus a ceramic piezoelectric device made of PZT (lead zirconate titanate) or a polymer piezoelectric device made of PVDF (polyvinylidene fluoride) has been used as an ultrasound transmitter.

The issue here is that a resonance point of the piezoelectric device forms a sharp angle irrespective of the material, and the resonance frequency is used for driving so that the ultrasonic speaker is put in practical use. In this sense, the frequency domain that can ensure the high sound pressure is considerably narrow, i.e., is of narrow bandwidth.

The maximum frequency bandwidth audible for human beings is generally understood as 20 Hz to 20 kHz, and has a bandwidth of about 20 kHz. That is, if with an ultrasonic speaker, it is impossible to demodulate the original audio signal with fidelity unless the high sound pressure is kept over the frequency range of 20 kHz in the ultrasonic domain. For the previous ultrasonic speaker of resonance type using a piezoelectric device, it is easily understood that there is hardly a chance to reproduce (demodulate) such a broadband as 20 kHz with fidelity.

Actually, there have been problems with an ultrasonic speaker using the previous ultrasonic speaker of resonance type, e.g., narrow bandwidth with bad audio reproduction quality, the maximum degree of modulation is of about 0.5 because if the degree of AM modulation is increased too much, the demodulated audio will sound distorted, increasing an input voltage (increasing volume) causes unstable oscillation of a piezoelectric device and the audio thus sounds raspy, and a higher voltage easily damages the piezoelectric device, and difficulties in array configuration, size increase, and size reduction, thereby resulting in cost increase.

An ultrasonic speaker using the electrostatic ultrasonic transducer (Pull type) of FIG. 17 can nearly solve the problems of the previous technology. Although the ultrasonic speaker can cover a wide range of bandwidth, there is still a problem of the shortage of absolute sound pressure to derive sufficient volume for the demodulated audio.

The electrostatic ultrasonic transducer of Pull type has also a problem if it is used for an ultrasonic speaker. That is, the electrostatic force acts only in the direction toward the side of a fixed electrode, and thus an oscillation film (corresponding to the upper electrode 132 of FIG. 17) does not oscillate symmetrically. Therefore, in such a case, the oscillation of the oscillation film directly generates audio sound.

In consideration thereof, for the purpose of deriving the parametric array effects over a wide range of frequency, we inventors have already proposed an electrostatic ultrasonic transducer that can generate an acoustic signal being sufficiently high in sound pressure level. In this electrostatic ultrasonic transducer, an oscillation film with a conductor layer is sandwiched between a pair of fixed electrodes each formed with through holes at their opposing positions. The pair of fixed electrodes are applied with an alternating signal in the state that the oscillation film is being applied with the DC bias voltage.

Such an electrostatic ultrasonic transducer is called electrostatic ultrasonic transducer of Push-Pull type, in which an oscillation film sandwiched between a pair of fixed electrodes receives the electrostatic suction force and the electrostatic repulsive force at the same time in the same direction corresponding to the polarity of the alternating signal. This not only allows to sufficiently increase the oscillation amplitude of the oscillation film to derive the parametric array effects but also to keep the oscillation symmetrical so that the transducer of Push-Pull type can generate the higher sound pressure over a wide range of frequency compared with the previous electrostatic ultrasonic transducer of Pull type.

Even with such an electrostatic ultrasonic transducer of Push-Pull type, however, if no change is made thereto, there is still a difficulty in generating the sufficient level of sound pressure in the air. This is because the through holes are relatively small in size to make the sound pass therethrough.

As such, even the electrostatic ultrasonic transducer of such Push-Pull type is not yet enough to generate the sufficient level of sound pressure.

SUMMARY

An advantage of some aspects of the invention is to provide, firstly, an electrostatic ultrasonic transducer of Push-Pull type which can generate more intense ultrasound under the same drive conditions as with others, and which is aimed to increase the efficiency of conversion between the electrical energy and the acoustic energy.

Another advantage of some aspects of the invention is to provide, secondly, an ultrasonic speaker using the electrostatic ultrasonic transducer of Push-Pull type, an audio signal reproduction method using the electrostatic ultrasonic transducer, a manufacturing method of an electrode for use in the ultrasonic transducer, an ultrasonic transducer manufacturing method, a superdirective acoustic system, and a display device.

A first aspect of the invention is directed to an electrostatic ultrasonic transducer that includes, a first electrode that is formed with a plurality of holes; a second electrode that is formed with a plurality of holes, and is used in pair with the first electrode; an oscillation film formed with a conductor layer that is sandwiched between the pair of electrodes, and the conductor layer is applied with a direct-current (DC) bias voltage; and a retention member that keeps hold of the pair of electrodes and the oscillation film. In the transducer, an alternating signal is applied between the pair of electrodes, and the pair of electrodes each have a thickness t of about $(\lambda/4)\cdot n$ (where $\lambda$ denotes a wavelength of ultrasound, and n denotes a positive odd number).

With the electrostatic ultrasonic transducer of the first aspect configured as above, the first and second electrodes are each formed with a plurality of holes at their opposing positions. Such a pair of electrodes, i.e., the first and second electrodes, are applied with an alternating signal serving as a drive signal in the state that the conductor layer of the oscillation film is being applied with a DC bias voltage. Accordingly, the oscillation film sandwiched between the pair of electrodes receives the electrostatic suction force and the electrostatic repulsive force at the same time in the same direction corresponding to the polarity of the alternating signal. This not only allows to sufficiently increase the oscillation amplitude of the oscillation film to derive the parametric array effects but also to keep the oscillation symmetrical so that the high sound pressure can be generated over a wide range of frequency.

Further, the pair of electrodes are each configured to have the thickness t of about $(\lambda/4)\cdot n$ (where $\lambda$ denotes a wavelength of ultrasound, and n denotes a positive odd number). This allows the thickness of each of the electrodes of a portion formed with the through hole configures a resonance tube so that the sound pressure can be maximized in the vicinity of an exit port of the electrode. As such, this enables the electrostatic ultrasonic transducer of Push-Pull type to generate more intense ultrasound under the same drive conditions as with others, i.e., the efficiency of conversion can be increased between the electrical energy and the acoustic energy.

A second aspect of the invention is directed to an electrostatic ultrasonic transducer that includes: a first electrode that is formed with a plurality of holes; a second electrode that is formed with a plurality of holes, and is used in pair with the first electrode; an oscillation film formed with a conductor layer that is sandwiched between the pair of electrodes, and the conductor layer is applied with a direct-current (DC) bias voltage; and a retention member that keeps hold of the pair of electrodes and the oscillation film. In the transducer, an alternating signal is applied between the pair of electrodes, and the pair of electrodes each have a thickness t of $(\lambda/4)\cdot n-\lambda/8 \leqq t \leqq (\lambda/4)\cdot n+\lambda/8$ (where $\lambda$ denotes a wavelength of ultrasound, and n denotes a positive odd number).

With the electrostatic ultrasonic transducer of the second aspect configured as above, the first and second electrodes are each formed with a plurality of holes at their opposing positions. Such a pair of electrodes, i.e., the first and second electrodes, are applied with an alternating signal serving as a drive signal in the state that the conductor layer of the oscillation film is being applied with a DC bias voltage. Accordingly, the oscillation film sandwiched between the pair of electrodes receives the electrostatic suction force and the electrostatic repulsive force at the same time in the same direction corresponding to the polarity of the alternating signal. This not only allows to sufficiently increase the oscillation amplitude of the oscillation film to derive the parametric array effects but also to keep the oscillation symmetrical so that the high sound pressure can be generated over a wide range of frequency.

Further, the pair of electrodes are each configured to have the thickness t of $(\lambda/4)\cdot n-\lambda/8 \leqq t \leqq (\lambda/4)\cdot n+\lambda/8$ (where $\lambda$ denotes a wavelength of ultrasound, and n denotes a positive odd number). This allows the thickness of each of the electrodes of a portion formed with the through hole configures a resonance tube so that the sound pressure can be set to a value substantially close the maximum in the vicinity of an exit port of the electrode. As such, this enables the electrostatic ultrasonic transducer of Push-Pull type to generate more intense ultrasound under the same drive conditions as with others, i.e., the efficiency of conversion can be increased between the electrical energy and the acoustic energy.

In the electrostatic ultrasonic transducer according to the aspects of the invention, the holes formed to the pair of electrodes are each formed as a cylindrical through hole.

In the electrostatic ultrasonic transducer configured as such, ultrasound generated by the oscillation of the oscillation film is emitted via the through holes, which are formed cylindrical to the pair of electrodes. The advantage of the cylindrical through holes is that they can be manufactured in the easiest manner, and the drawback thereof is that the electrostatic force acting between the conductor layer of the oscillation film is weak because the side of the electrode has no electrode portion facing the oscillation film.

Further, in the electrostatic ultrasonic transducer according to the aspects of the invention, the holes formed to the pair of electrodes are each a through hole having a configuration that at least two or more of concentric cylindrical holes varying in diameter and depth are coupled.

In the electrostatic ultrasonic transducer configured as such, the through holes formed to the pair of electrodes are each a hole having a configuration that at least two or more of concentric cylindrical holes varying in diameter and depth are coupled. As such, the portions of the electrodes parallel to the edge portions of the size-varying concentric cylindrical holes formed to the electrodes are so configured as to face the conductor layer of the oscillation film so that a parallel capacitor is formed. Accordingly, when the portion of the oscillation film facing the edge portions of the holes is lifted upward, another force is acted in the downward direction at the same time so that the oscillation film can be oscillated with larger amplitude.

Still further, in the electrostatic ultrasonic transducer according to the aspects of the invention, the holes formed to the pair of electrodes each have a tapered cross section.

In the electrostatic ultrasonic transducer configured as such, the through holes formed to the pair of electrodes each have a tapered cross section. The tapered portions of the electrodes are thus configured to face the conductor layer of the oscillation film so that a parallel capacitor is formed.

Accordingly, when the portion of the oscillation film facing the tapered portions of the fixed electrodes is lifted upward, another force is acted in the downward direction at the same time so that the oscillation film can be oscillated with larger amplitude.

Still further, in the electrostatic ultrasonic transducer according to the aspects of the invention, the holes formed to the pair of electrodes are each a through hole whose plane surface is rectangular.

In the electrostatic ultrasonic transducer configured as such, ultrasound generated by the oscillation of the oscillation film is emitted via the through holes formed to the pair of electrodes each with a rectangular plane surface. The advantage of the through holes each configured to have a rectangular plane surface as such is that they can be manufactured in the easiest manner, and the drawback thereof is that the electrostatic force acting between the conductor layer of the oscillation film is weak because the side of the electrode has no electrode portion facing the oscillation film.

Still further, in the electrostatic ultrasonic transducer according to the aspects of the invention, the holes formed to the pair of electrodes are each a through hole being formed on a center line of each of the electrodes, and having a configuration that at least two or more of rectangular holes of the same length but of different diameter and depth are coupled.

In the electrostatic ultrasonic transducer configured as such, the through holes formed to the pair of electrodes are each a through hole being formed on a center line of each of the electrodes, and having a configuration that at least two or more of rectangular holes of the same length but of different diameter and depth are coupled. As such, the portions of the electrodes parallel to the edge portions of the size-varying rectangular holes formed to the electrodes are so configured as to face the conductor layer of the oscillation film so that a parallel capacitor is formed. Accordingly, when the portion of the oscillation film facing the edge portions of the holes is lifted upward, another force is acted in the downward direction at the same time so that the oscillation film can be oscillated with larger amplitude.

Still further, in the electrostatic ultrasonic transducer according to the aspects of the invention, the rectangular through holes formed to the pair of electrodes each have a tapered cross section.

In the electrostatic ultrasonic transducer configured as such, the through holes formed to the pair of electrodes each have a rectangular plane and a tapered cross section. The tapered portions of the electrodes are thus configured to face the conductor layer of the oscillation film so that a parallel capacitor is formed.

Accordingly, when the portion of the oscillation film facing the tapered portions of the fixed electrodes is lifted upward, another force in the downward direction is acted at the same time so that the oscillation film can be oscillated with larger amplitude.

Still further, in the electrostatic ultrasonic transducer according to the aspects of the invention, the holes formed to the pair of electrodes on the side of the oscillation film each have a larger hole diameter and a shallower depth than the holes formed on the opposite side of the oscillation film.

In the electrostatic ultrasonic transducer configured as such, the holes formed to the pair of electrodes on the side of the oscillation film each have a larger hole diameter and a shallower depth than the holes formed on the opposite side of the oscillation film. The portions of the electrodes parallel to the edge portions of the size-varying concentric cylindrical holes are configured to face the conductor layer of the oscillation film so that a parallel capacitor is formed. Accordingly, the electrostatic suction force and the electrostatic repulsive force acting on the conductor layer of the oscillation film can be increased.

Still further, in the electrostatic ultrasonic transducer according to the aspects of the invention, the rectangular holes formed to the pair of electrodes on the side of the oscillation film each have a larger width and a shallower depth than the holes formed on the opposite side of the oscillation film.

In the electrostatic ultrasonic transducer configured as such, the rectangular holes formed to the pair of electrodes on the side of the oscillation film each have a larger width and a shallower depth than the holes formed on the opposite side of the oscillation film. The portions of the electrodes parallel to the edge portions of the size-varying rectangular holes or the tapered portions of the electrodes are configured to face the conductor layer of the oscillation film so that a parallel capacitor is formed. Accordingly, the electrostatic suction force and the electrostatic repulsive force acting on the conductor layer of the oscillation film can be increased.

Still further, in the electrostatic ultrasonic transducer according to the aspects of the invention, the through holes are of the same size.

In the electrostatic ultrasonic transducer configured as such, the pair of electrodes are each formed with the through holes of the same size. Accordingly, the holes can be processed with ease, and the manufacturing cost can be thus reduced.

Still further, in the electrostatic ultrasonic transducer according to the aspects of the invention, the through holes at opposing positions have the same size, and the size of the through holes varies.

In the electrostatic ultrasonic transducer configured as such, the through holes formed to the pair of electrodes at their opposing positions have the same size, and the size of the through holes varies. Accordingly, the holes can be processed with ease, and the manufacturing cost can be thus reduced.

Still further, in the electrostatic ultrasonic transducer according to the aspects of the invention, the pair of electrodes are each configured by a single piece of conductor member.

In the electrostatic ultrasonic transducer configured as such, the pair of electrodes can be each configured by a single piece of conductor member, which is singly made of a conductor material such as SUS (stainless steel), brass, iron, nickel, or others.

Still further, in the electrostatic ultrasonic transducer according to the aspects of the invention, the pair of electrodes are each configured by a plurality of conductor members.

In the electrostatic ultrasonic transducer configured as such, the pair of electrodes can be each configured by a plurality of conductor members.

Still further, in the electrostatic ultrasonic transducer according to the aspects of the invention, the pair of electrodes are configured by a conductor member and an insulator member.

In the electrostatic ultrasonic transducer configured as such, the pair of electrodes can be configured by a conductor member and an insulator member. For example, to configure an electrode with a conductor member and an insulator member, an insulator member exemplified by a glass epoxy substrate or a paper phenolic substrate is subjected to any desired hole processing, and then the insulator member is subjected to plating using nickel, gold, silver, copper, and others. With the electrodes formed as such, the resulting ultrasonic transducer can be reduced in weight.

Still further, in the electrostatic ultrasonic transducer according to the aspects of the invention, the oscillation film is formed with an electrode layer on both surfaces of an insulator polymer film.

In the electrostatic ultrasonic transducer configured as such, the oscillation film is formed with an electrode layer on both surfaces of an insulator polymer film. After such layer formation, as will be described later, an insulator layer is provided on the side of the electrode facing the oscillation film. This favorably simplifies the manufacturing process for the oscillation film.

Still further, in the electrostatic ultrasonic transducer according to the aspects of the invention, the oscillation film is formed by an electrode layer being sandwiched between two insulator polymer films.

In the electrostatic ultrasonic transducer configured as such, the oscillation film is formed by an electrode layer being sandwiched between insulator layers (insulator polymer films). Accordingly, this eliminates the need for an insulation process on the sides of the electrodes so that the ultrasonic transducer can be manufactured with more ease. What is more, the electrodes can be disposed with symmetry with respect to the oscillation film.

Still further, in the electrostatic ultrasonic transducer according to the aspects of the invention, the oscillation film is configured by using the two insulator polymer films each formed on one surface with the electrode layer, and the electrode layers are closely attached to each other.

In the electrostatic ultrasonic transducer configured as such, the oscillation film is configured by using the two insulator polymer films each formed with the electrode layer, and the electrode layers are closely attached to each other. Accordingly, this simplifies the manufacturing process for the oscillation film.

Still further, in the electrostatic ultrasonic transducer according to the aspects of the invention, the oscillation film is an electret film.

In the electrostatic ultrasonic transducer configured as such, the oscillation film is an electret film, and in this case, the insulator layer is formed on the sides of the electrodes. This accordingly simplifies the manufacturing process for the oscillation film.

Still further, in the electrostatic ultrasonic transducer according to the aspects of the invention, the oscillation film is configured by an insulator polymer film formed with an electrode layer on both surfaces, or the oscillation film is an electret film, and an electrical insulation process is applied to each of the pair of electrodes on the side of the oscillation film.

In the electrostatic ultrasonic transducer configured as such, when an oscillation film is formed with a conductor layer (electrode layer) on both surfaces of the insulator layer (insulator film), or when an oscillation film is an electret film, each of the fixed electrodes on the side of the oscillation film is subjected to an electrical insulation process. Therefore, the oscillation film possible for use includes a two-sided electrode evaporation film with which a conductor layer (electrode layer) is formed on both surfaces of an insulator layer (insulator film), and an electret film.

Still further, in the electrostatic ultrasonic transducer according to the aspects of the invention, the oscillation film is applied with the DC bias voltage of a single polarity.

In the electrostatic ultrasonic transducer configured as such, the oscillation film is applied with a DC bias voltage of a single polarity. As such, the electrode layer of the oscillation film always carries thereon the electric charge of the same polarity. The oscillation film thus oscillates in response to the electrostatic suction force and the electrostatic repulsive force based on the polarity of the voltage that changes depending on an alternating signal applied to the pair of electrodes.

Still further, in the electrostatic ultrasonic transducer according to the aspects of the invention, the retention member that keeps hold of the pair of electrodes and the oscillation films is made of an insulator material.

In the electrostatic ultrasonic transducer configured as such, the retention member that keeps hold of the pair of electrodes and the oscillation film is made of an insulator material. This enables to keep the electrical insulation between the electrodes and the oscillation film.

Still further, in the electrostatic ultrasonic transducer according to the aspects of the invention, the oscillation film is fixed under a tension in four perpendicular directions on a surface thereof.

In the electrostatic ultrasonic transducer configured as such, the oscillation film is fixed under a tension in four perpendicular directions on a surface thereof. This thus eliminates the previous need to apply a DC bias voltage of several hundreds of volts to the oscillation film to absorb the oscillation film to the sides of the electrodes. That is, when the film unit is manufactured for the oscillation film, fixing the film under a tension favorably produces the effects similar to the tensile strength taken charge by the DC bias voltage so that the DC bias voltage can be reduced.

Still further, in the electrostatic ultrasonic transducer according to the aspects of the invention, an acoustic reflector plate is disposed on one surface.

In the electrostatic ultrasonic transducer configured as such, the acoustic reflector plate is disposed on one surface, e.g., rear surface, and the ultrasound coming from the rear surface is reflected on the front surface. Such an acoustic reflector plate is so disposed that the ultrasound coming from the aperture portions formed on the rear surface of the electrostatic ultrasonic transducer is directed to the front surface thereof through paths of the same length, for example. With such a configuration, the ultrasound coming from the front and rear surfaces of the electrostatic ultrasonic transducer can be effectively utilized.

Still further, in the electrostatic ultrasonic transducer according to the aspects of the invention, the acoustic reflector plate is configured by: a pair of first reflector plates whose one end is at a center position of the one surface of the electrostatic ultrasonic transducer with an angle of 45 degrees against the one surface thereof relative to the center position, and whose length extends to a point at which the other end thereof matches an end portion of the electrostatic ultrasonic transducer; and a pair of second reflector plates are connected to the other ends of the first reflector plates in an outer direction with an angle of 90 degrees, and have a length similar to the length of the first reflector plates.

In the electrostatic ultrasonic transducer configured as such, the acoustic reflector plate is so disposed that the ultrasound coming from the aperture portions formed on one surface, e.g., rear surface, of the electrostatic ultrasonic transducer is directed to the other surface, e.g., front surface, thereof through paths of the same length, for example. That is, a pair of first reflector plates are disposed with an angle of 45 degrees against the rear surface of the electrostatic ultrasonic transducer relative to a center position M, and the first reflector plates have a length that extends to a point at which one end thereof matches an end portion of the electrostatic ultrasonic transducer. Such first reflector plates reflect the ultrasound emitted from the rear surface of the electrostatic ultrasonic transducer in the horizontal direction. With a pair of second reflector plates that are connected to the first reflector plates in an outer direction with an angle of 90 degrees, the ultrasound is directed to the front surface of the electrostatic ultrasonic transducer from its sides or upper or lower portion thereof. These second reflector plates are required to have the length similar to that of the first reflector plates. Such a configuration allows the ultrasound emitted from the rear surface of the ultrasonic transducer to be reflected after going through the paths of the same length, and the ultrasonic emitted from the rear surface to the front surface to have the same phase.

This enable to effectively utilize the ultrasound coming from the front and rear surfaces of the electrostatic ultrasonic transducer.

A third aspect of the invention is directed to an ultrasonic speaker that includes: the electrostatic ultrasonic transducer of any one of those described above; a signal source that generates a signal wave in an audio frequency band; a carrier wave supply unit that generates and outputs a carrier wave in an ultrasonic frequency band; and a modulation unit that modulates the carrier wave by the signal wave in the audio frequency band provided by the signal source. In the ultrasonic speaker, the electrostatic ultrasonic transducer is driven by a modulation signal that is applied between the electrodes and the electrode layers formed to the oscillation film, and is provided by the modulation unit.

In the ultrasonic speaker of the third aspect configured as such, the signal source generates a signal wave in an audio frequency band, and the carrier wave supply unit generates and outputs a carrier wave in the ultrasonic frequency band. Moreover, the carrier wave is modulated by the modulation unit using the signal wave in the audio frequency band provided by the signal source. The resulting modulation signal provided by the modulation unit is applied between the electrodes and the electrode layer of the oscillation film so that the ultrasonic speaker is driven.

As such, the ultrasonic speaker according to the third aspect of the invention is configured using the electrostatic ultrasonic transducer of the configuration as described above. This enables the resulting ultrasonic speaker to generate an acoustic signal of a sound pressure level sufficiently high to derive the parametric array effects over a wide range of frequency.

Further, the ultrasonic speaker according to the third aspect of the invention is using the electrostatic ultrasonic transducer in which the pair of electrodes are each configured to have the thickness t of about $(\lambda/4)\cdot n$ (where $\lambda$ denotes a wavelength of ultrasound, and n denotes a positive odd number) or $(\lambda/4)\cdot n-\lambda/8 \leqq t \leqq (\lambda/4)\cdot n+\lambda/8$ (where $\lambda$ denotes a wavelength of ultrasound, and n denotes a positive odd number). This allows the thickness of each of the electrodes of a portion formed with the through hole configures a resonance tube so that the sound pressure can be maximized in the vicinity of an exit port of the electrode. As such, this enables the ultrasonic speaker to generate more intense ultrasound under the same drive conditions as with others.

A fourth aspect of the invention is directed to an audio signal reproduction method using the electrostatic ultrasonic transducer of any one of those described above. The method includes: generating a signal wave in an audio frequency band by a signal source; generating a carrier wave in an ultrasonic frequency band by a carrier wave supply source; generating a modulation signal that is a modulation result of the carrier wave by the signal wave in the audio frequency band; and driving the electrostatic ultrasonic transducer by applying the modulation signal between the electrodes and the electrode layers formed to the oscillation film.

In the audio signal reproduction method including such a procedure for an electrostatic ultrasonic transducer, the signal source generates a signal wave in an audio frequency band, and the carrier wave supply source generates and outputs a carrier wave in the ultrasonic frequency band. Moreover, the carrier wave is modulated by the signal wave in the audio frequency band. The resulting modulation signal is applied between the electrodes and the electrode layer of the oscillation film so that the electrostatic ultrasonic transducer is driven.

The electrostatic ultrasonic transducer configured as such becomes able to generate an acoustic signal of a sound pressure level sufficiently high to derive the parametric array effects over a wide range of frequency, and to reproduce an audio signal.

A fifth aspect of the invention is directed to a manufacturing method of an electrode for use in the electrostatic ultrasonic transducer of any one of those described above. The method includes: covering a conductor plate for formation of an electrode portion to the pair of electrodes with a mask member formed with a pattern of a plurality of through holes, and forming the plurality of through holes on the conductor plate by etching; and stacking the conductor plate formed with the through holes to have a thickness t of about $(\lambda/4)\cdot n$ (where $\lambda$ denotes a wavelength of ultrasound, and n denotes a positive odd number) or $(\lambda/4)\cdot n-\lambda/8 \leqq t \leqq (\lambda/4)\cdot n+\lambda/8$ (where $\lambda$ denotes a wavelength of ultrasound, and n denotes a positive odd number) for the resulting stack of the conductor plates.

In the electrode manufacturing method including such a procedure for use in an electrostatic ultrasonic transducer, the conductor plate of a predetermined thickness for formation of the electrode portion to the pair of electrodes is covered with the mask member formed with a pattern of a plurality of through holes, and a plurality of through holes are formed on the conductor plate by etching. The resulting conductor plate is stacked on one another so that the thickness t of the electrode configured by the stack of conductor plates is set to about $(\lambda/4)\cdot n$ (where $\lambda$ denotes a wavelength of ultrasound, and n denotes a positive odd number) or $(\lambda/4)\cdot n-\lambda/8 \leqq t \leqq (\lambda/4)\cdot n+\lambda/8$ (where $\lambda$ denotes a wavelength of ultrasound, and n denotes a positive odd number). For example, if the thickness of the conductor plate is 0.25 mm, and if the electrode is required to have a thickness of 1.5 mm, six pieces of the conductor plate are stacked together.

With such a method, the electrode can be easily manufactured with the thickness t of about $(\lambda/4)\cdot n$ (where $\lambda$ denotes a wavelength of ultrasound, and n denotes a positive odd number) or $(\lambda/4)\cdot n-\lambda/8 \leqq t \leqq (\lambda/4)\cdot n+\lambda/8$ (where $\lambda$ denotes a wavelength of ultrasound, and n denotes a positive odd number).

Further, the electrode manufacturing method of the fifth aspect for use in an electrostatic ultrasonic transducer further includes: forming, to the conductor plate formed with the through holes, a nonconductive photosensitive resist of a predetermined thickness as a material for forming an oscillation film sandwich portion; covering a surface of the nonconductive photosensitive resist with a mask member for forming the oscillation film sandwich portion designed with a pattern of the oscillation film sandwich portion, and exposing a result to light; and peeling off the mask member for forming the oscillation film sandwich portion, and removing an unnecessary portion of the photosensitive resist through developing.

The electrode manufacturing method including such a procedure further includes forming, to the conductor plate formed with the through holes, a nonconductive photosensitive resist of a predetermined thickness as a material for forming the oscillation film sandwich portion; covering a surface of the nonconductive photosensitive resist with the mask member for forming the oscillation film sandwich portion designed with a pattern of the oscillation film sandwich portion, and exposing a result to light; and peeling off the mask member for forming the oscillation film sandwich portion, and removing an unnecessary portion of the photosensitive resist through developing. This accordingly shortens the manufacturing procedure because the previously-required procedure after metal electroforming is no more required, thereby reducing the manufacturing cost. This also eliminates the solution or others for use to peel off any remaining resist, e.g., strong alkali solution, so that this serves well in terms of environmental protection.

Still further, the electrode manufacturing method of the fifth aspect for use in an electrostatic ultrasonic transducer further includes: setting, on a surface of the conductor plate formed with the through holes, a screen printed board carrying thereon a mask member for forming an oscillation film sandwich portion, and a liquid material for forming the oscillation film sandwich portion; coating, after the screen printed board and the liquid material for forming the oscillation film sandwich portion are set on the surface of the conductor plate formed with the through holes, the material for forming the oscillation film sandwich portion to a portion not covered by the mask member by running a squeegee; and removing the screen printed board after the material for forming the oscillation film sandwich portion is coated to the portion not covered by the mask member, and drying the material for forming the oscillation film sandwich portion remaining on the surface of the conductor plate.

The electrode manufacturing method including for such a procedure for use in an electrostatic ultrasonic transducer further includes: setting, on a surface of the conductor plate formed with the through holes, a screen printed board carrying thereon the mask member for forming the oscillation film sandwich portion, and a liquid material for forming the oscillation film sandwich portion; coating, after the screen printed board and the liquid material for forming the oscillation film sandwich portion are set on the surface of the conductor plate formed with the through holes, the material for forming the oscillation film sandwich portion to a portion not covered by the mask member by running a squeegee; and removing the screen printed board after the material for forming the oscillation film sandwich portion is coated to the portion not covered by the mask member, and drying the material for forming the oscillation film sandwich portion remaining on the surface of the conductor plate. This favorably eliminates the previously-required procedure after metal electroforming, and does not need at all such operation as developing for photolithography so that the manufacturing procedure can be considerably reduced, and the manufacturing cost can be greatly reduced.

A sixth aspect of the invention is directed to an electrostatic ultrasonic transducer manufacturing method of manufacturing an electrostatic ultrasonic transducer by using the electrode manufacturing method according to any one of those described above.

With the electrostatic ultrasonic transducer manufacturing method according to the sixth aspect of the invention, an electrostatic ultrasonic transducer is manufactured by using the electrode manufacturing method of any one of those described above. This thus leads to the effects similar to those derived by any one of the electrode manufacturing methods described above.

A seventh aspect of the invention is directed to a superdirective acoustic system that reproduces an audio signal provided by an acoustic source, and forms a virtual sound source in the vicinity of an acoustic wave reflector surface exemplified by a screen with an ultrasonic speaker configured using the electrostatic ultrasonic transducer of any one of those described above. The system includes: the ultrasonic speaker that reproduces a signal in the mid- to high-frequency ranges from the audio signal provided by the acoustic source; and a bass reproduction speaker that reproduces an audio in the bass-frequency range from the audio signal provided by the acoustic source.

With the superdirective acoustic system configured as such, used is an ultrasonic speaker configured by an electrostatic ultrasonic transducer having the thickness t of about $(\lambda/4)\cdot n$ (where $\lambda$ denotes a wavelength of ultrasound, and n denotes a positive odd number) or $(\lambda/4)\cdot n-\lambda/\leqq t\leqq(\lambda/4)\cdot n+\lambda/8$ (where $\lambda$ denotes a wavelength of ultrasound, and n denotes a positive odd number). Using such an ultrasonic speaker, any audio signal in the mid- to high-frequency ranges is reproduced from those others supplied from the acoustic source, and by the bass reproduction speaker, any audio signal in the bass-frequency range is reproduced from those others provided by the acoustic source.

As such, the audio in the mid- to high-frequency ranges can be reproduced with a sufficient level of sound pressure in a wide range of frequency from a virtual sound source, which is formed in the vicinity of an acoustic wave reflector plate exemplified by a screen. What is more, because the audio in the bass-frequency range is directly output from a bass reproduction speaker equipped to the acoustic system, the bass-frequency range can be enhanced so that the resulting sound field adds more sense of realism.

An eighth aspect of the invention is directed to a display device that is configured by including the electrostatic ultrasonic transducer of any one of those described above. The display device includes: an ultrasonic speaker that reproduces a signal sound in an audio frequency band from an audio signal provided by an acoustic source; and a projection system that projects a video on a projection surface.

With a projector configured as above, used is an ultrasonic speaker configured by an electrostatic ultrasonic transducer having the thickness t of about $(\lambda/4)\cdot n$ (where $\lambda$ denotes a wavelength of ultrasound, and n denotes a positive odd number) or $(\lambda/4)\cdot n-\lambda/8\leqq t\leqq(\lambda/4)\cdot n+\lambda/8$ (where $\lambda$ denotes a wavelength of ultrasound, and n denotes a positive odd number). Such an ultrasonic speaker reproduces an audio signal coming from an acoustic source.

As such, the acoustic signal can be reproduced with a sufficient level of sound pressure in a wide range of frequency from a virtual sound source, which is formed in the vicinity of an acoustic wave reflector plate exemplified by a screen. This accordingly enables to exercise control with ease over the reproduction range of the acoustic signal.

BRIEF DESCRIPTION OF THE DRAWINGS

The invention will be described with reference to the accompanying drawings, wherein like numbers reference like elements.

FIG. 5 is a plane view of the fixed electrode showing the configuration thereof formed with through holes in the ultrasonic transducer in the embodiment of the invention.

FIGS. 6A and 6B are each a cross section, viewed from the front, of the fixed electrode serving as a resonance tube unit being a cluster of resonance tubes, and showing the resonance state of audio.

DESCRIPTION OF EXEMPLARY EMBODIMENTS

Figure 1A:
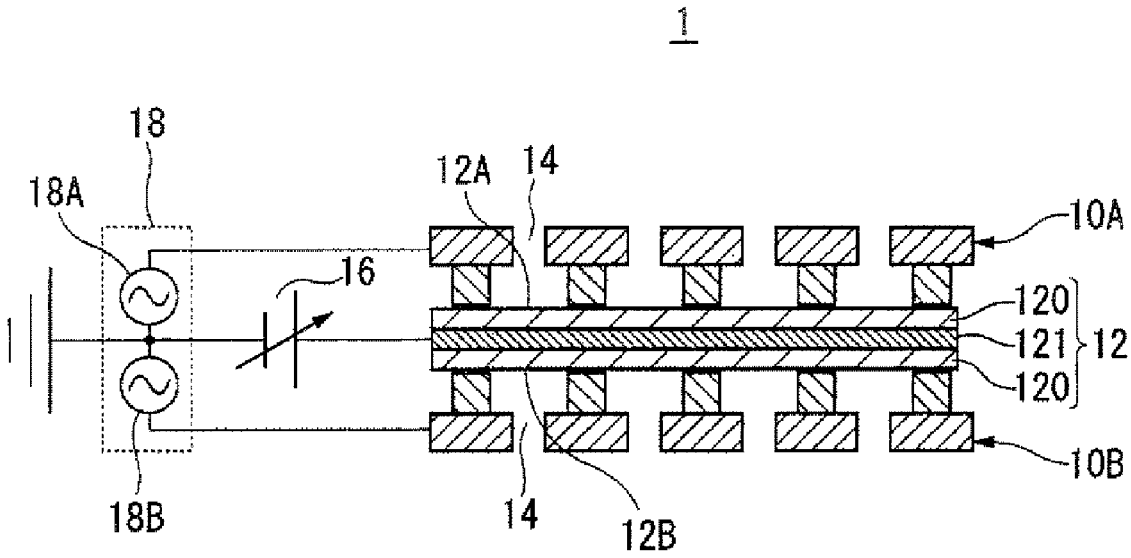
FIGS. 1A and 1B are each a diagram showing the configuration of an ultrasonic transducer in an embodiment of the invention.
Figure 1B:
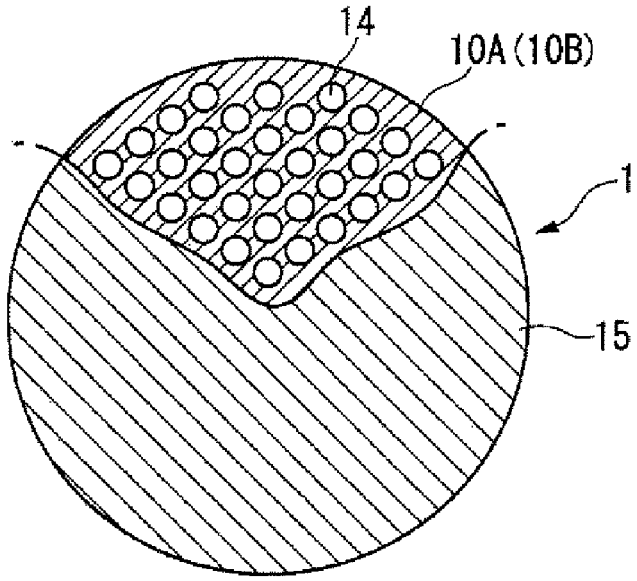

Description about Exemplary Configuration of Electrostatic Ultrasonic Transducer of Invention In the below, by referring to the accompanying drawings, embodiments of the invention are described in detail. FIGS. 1A and 1B show the configuration of an electrostatic ultrasonic transducer of an embodiment of the invention. FIG. 1A shows the configuration of an electrostatic ultrasonic transducer, and FIG. 1B shows a plane view of the ultrasonic transducer that is partially fractured.

In FIGS. 1A and 1B, an electrostatic ultrasonic transducer 1 in the embodiment of the invention is configured to include a pair of fixed electrodes 10A and 10B, an oscillation film 12 sandwiched by a pair of fixed electrodes and formed with an electrode layer 121, and a member (not shown) for keeping hold of the fixed electrodes 10A and 10B and the oscillation film. The fixed electrodes 10A and 10B each include a conductor member that is made of a conductor material and serves as an electrode.

The oscillation film 12 is made of an insulator (insulator layer) 120, and includes the electrode layer 121 made of a conductor material. The electrode layer 121 is to receive a direct-current (DC) bias voltage of a single polarity from a DC bias power supply 16. The polarity may be either positive or negative. Over the DC bias voltage, the fixed electrodes 10A and 10B are to receive alternating signals 15A and 18B between the electrode layer 121. The alternating signals 15A and 18B are provided by a signal source 18, and have opposite phase.

The fixed electrode 10A is formed with a plurality of through holes 14 at positions opposing to those formed to the fixed electrode 10B via the oscillation film 12. The fixed electrode 10A has the through holes 14 as many as those of the fixed electrode 10B. Between the conductor member of the fixed electrode 10A and that of the fixed electrode 10B, the alternating signals 15A and 18S having opposite phase are to be applied by the signal source 18. A capacitor is formed to the fixed electrode 10A and the electrode layer 121, and to the fixed electrode 10B and the electrode layer 121.

With such a configuration, in the ultrasonic transducer 1, the electrode layer of the oscillation film 12 is applied with a DC bias voltage of a single polarity (in this embodiment, positive polarity) by the DC bias power supply 16. Over the DC bias voltage, the alternating signals 18A and 18B which are provided by the signal source 18 and have opposite phase are applied.

On the other hand, the fixed electrodes 10A and 10B are applied with the alternating signals 15A and 18B having opposite phase by the signal source 18.

With such signal application, in a positive half cycle of the alternating signal 18A coming from the signal source 18, the fixed electrode 10A is applied with a positive voltage. This makes the electrostatic rebound force act on a surface portion 12A of the oscillation film 12 not sandwiched by the fixed electrodes. The surface portion 12A is thus pulled downward in FIG. 1A.

At this time, the alternating signal 18B will be in a negative cycle, and the opposite fixed electrode 10B is applied with a negative voltage. Accordingly, the electrostatic suction force acts on an underside portion 12B of the oscillation film 12, i.e., the underside of the surface portion 12A, and the underside portion 12B is pulled downward to a further extent in FIG. 1A.

Accordingly, the portion of the oscillation film 12 not sandwiched by the fixed electrodes 10A and 10B receives the electrostatic suction force and the electrostatic rebound force (electrostatic repulsive force) in the same direction. This is applicable also to the negative half cycle of the alternating signal coming from the signal source 18, and the electrostatic suction force acts on the surface portion 12A of the oscillation film 12 in the upward direction of FIG. 1A, and the electrostatic repulsive force acts on the underside portion 12B also in the upward direction thereof. The portion of the oscillation film 12 not sandwiched by the fixed electrodes 10A and 10B receives the electrostatic suction force and the electrostatic repulsive force in the same direction. As such, the direction in which the electrostatic force acts changes alternately in response to the polarity change occurred to the alternating signals while the oscillation film 12 is receiving the electrostatic suction force and the electrostatic repulsive force in the same direction. This accordingly enables to cause the oscillation film to oscillate with larger amplitude, i.e., generate an acoustic signal of a sound pressure level sufficient to derive the parametric array effects.

As such, in the ultrasonic transducer 1 in the embodiment of the invention, the oscillation film 12 oscillates in response to the force provided by the fixed electrodes 10A and 10B. In this sense, the ultrasonic transducer 1 is referred to as of Push-Pull type.

The ultrasonic transducer 1 in this embodiment of the invention is capable of achieving the broadband characteristics and the high sound pressure compared with the previous electrostatic ultrasonic transducer (Pull type) in which only the electrostatic suction force acts on the oscillation film.

Figure 18:
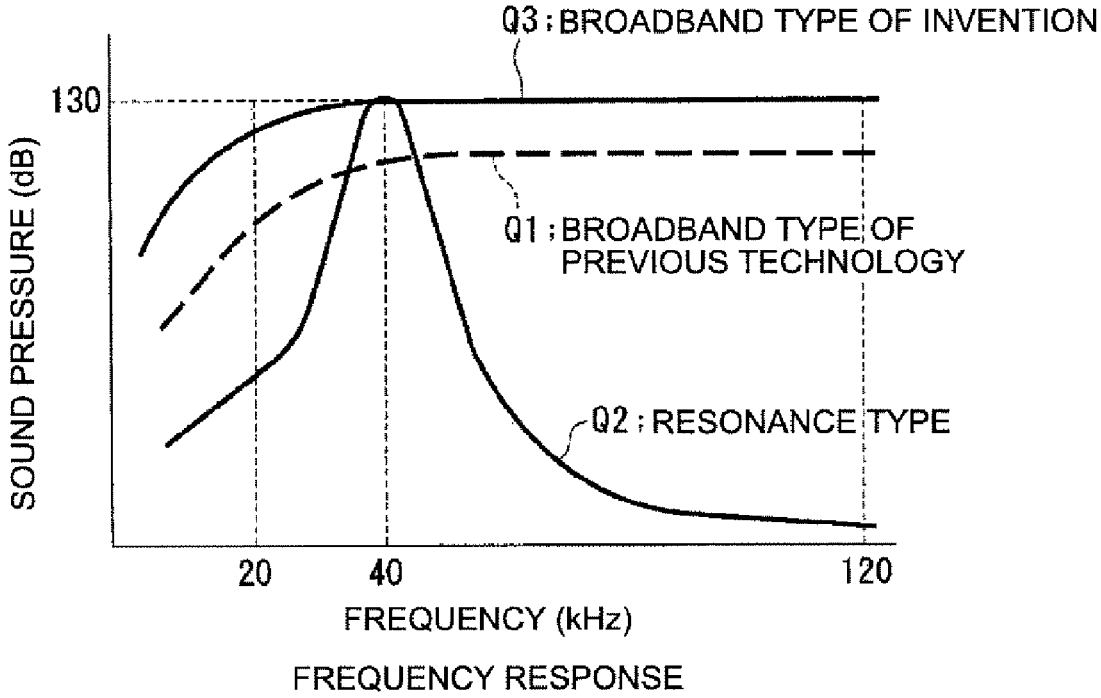
FIG. 18 is a diagram showing the frequency response of the ultrasonic transducer in the embodiment of the invention together with the frequency response of the previous ultrasonic transducer.

FIG. 18 shows the frequency response of the ultrasonic transducer in the embodiment of the invention. In the drawing, a curve Q3 shows the frequency response of the ultrasonic transducer of the embodiment. As is evident from the drawing, compared with the frequency response of the previous electrostatic ultrasonic transducer of broadband type, the ultrasonic transducer of this embodiment can derive a high sound pressure level over a wide range of frequency. More in detail, the ultrasonic transducer of this embodiment can derive the sound pressure level of 120 dB or higher, which leads to the parametric array effects in the frequency band of 20 kHz to 120 kHz.

In the ultrasonic transducer 1 in the embodiment of the invention, the thin oscillation film 12 sandwiched by the fixed electrodes 10A and 10B receives both the electrostatic suction force and the electrostatic repulsive force. This not only increases the oscillation amplitude but also ensures symmetric oscillation so that the high sound pressure can be generated over a wide range of frequency.

Figure 2A:
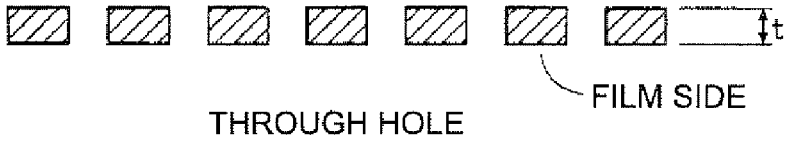
FIGS. 2A to 2C are each a diagram for illustrating a specific exemplary shape of a fixed electrode in the ultrasonic transducer in the embodiment of the invention.
Figure 2B:
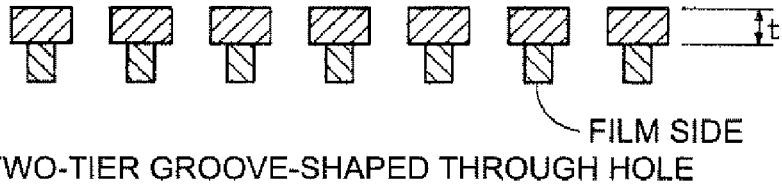
Figure 2C:
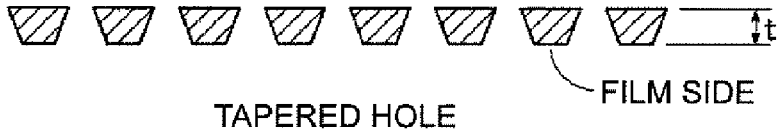

Described next is a fixed electrode for use in the ultrasonic transducer of this embodiment. FIGS. 2A to 2C each show a configuration example (cross sectional view) of a cylindrical fixed electrode (only one of a pair of fixed electrodes).

FIG. 2A shows a fixed electrode of through hole type. Specifically, holes formed to the fixed electrodes 10A and 10B are each a through hole formed cylindrical. The fixed electrode formed with such through holes can be manufactured in the simplest manner but has a drawback of the weak electrostatic force as is having no portion corresponding to the electrode facing the oscillation film 12.

FIG. 2B shows the configuration of a fixed electrode formed with a two-tier through hole. That is, holes formed to the fixed electrodes 10A and 10B each have a configuration that at least two or more, e.g., two in this embodiment, of concentric cylindrical holes varying in diameter and depth are coupled. The holes formed to the pair of electrodes on the side of the oscillation film each have a larger hole diameter and a shallower depth than the holes formed on the opposite side.

With such a configuration, the portion parallel to the edge portions of the holes is facing the oscillation film 12, and this portion is configuring a parallel plate capacitor.

Accordingly, the edge portion of the oscillation film 12 is lifted upward, and at the same time, another force acts in the downward direction so that the oscillation film can be oscillated with larger amplitude. FIG. 2C shows a though hole having a tapered cross section. The effects of using the fixed electrodes in such a shape are similar to those of the configuration of FIG. 2B.

Figure 3A:
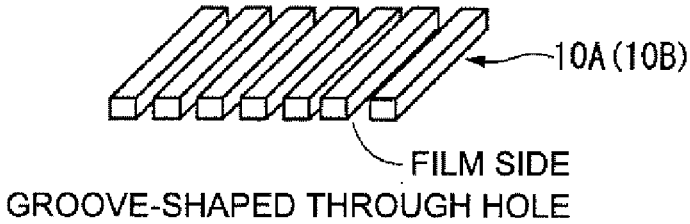
FIGS. 3A to 3C are each a diagram for illustrating a specific exemplary configuration of a through hole formed to the fixed electrode in the ultrasonic transducer in the embodiment of the invention.
Figure 3B:
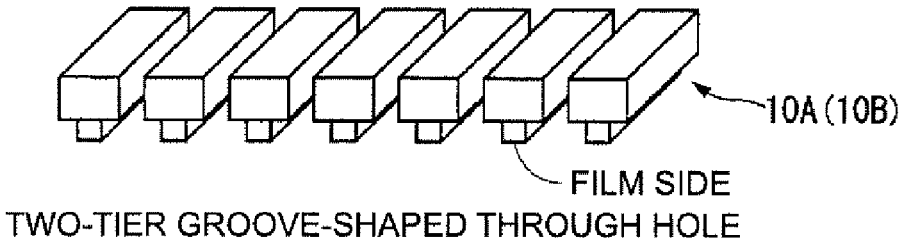
Figure 3C:
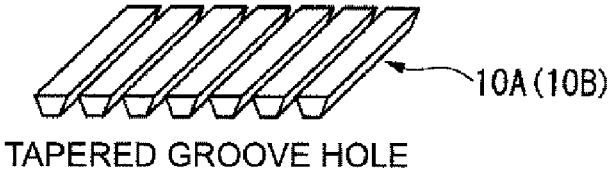

FIGS. 3A to 3C each show an exemplary configuration of a fixed electrode formed with a groove-shaped through hole (only one of a pair of fixed electrodes). FIG. 3A shows a groove-shaped through hole, and through holes formed to the fixed electrodes 10A and 10B each have a rectangular plane. The fixed electrode formed with such through holes is also manufactured in the simplest manner, but has a drawback of the weak electrostatic force as is having no portion corresponding to the electrode facing the oscillation film 12.

FIG. 3B shows the configuration of a fixed electrode formed with a two-tier grove-shaped through hole. That is, holes formed to the fixed electrodes 10A and 10B are each a through hole being formed on a center line of each of the electrodes, and having a configuration that at least two or more, e.g., two in this embodiment, of rectangular-plane holes of the same length but of different diameter and depth are coupled.

With such through holes, similarly to the cylindrical though holes, the portion parallel to the edge portions of the groove-shaped holes is facing the oscillation film 12 so that a parallel plate capacitor is configured thereby.

Accordingly, the edge portion of the oscillation film 12 is lifted upward, and at the same time, another force acts in the downward direction so that the oscillation film 12 can be oscillated with larger amplitude.

FIG. 3C shows a tapered groove-shaped though hole, i.e., the rectangular through holes formed to the electrodes 10A and 10B each have a tapered cross section. The effects of using the fixed electrodes in such a shape are similar to those of the fixed electrodes configured as shown in FIG. 3B.

Note here that in the exemplary configurations of FIGS. 3B and 3C, the rectangular holes formed to the fixed electrodes on the side of the oscillation film each have a larger width and a shallower depth than the holes formed on the opposite side.

The through holes formed to the fixed electrodes shown in the exemplary configurations of FIGS. 2A to 3C may be of the same size.

The through holes at opposing positions may have the same size, and the size of the through holes may vary.

The fixed electrode configuring the ultrasonic transducer of the embodiment may be configured by a single piece of conductor member, or by a plurality of conductor members.

The fixed electrode configuring the ultrasonic transducer of the embodiment may be configured by a conductor member and an insulator member.

More in detail, a conductor material serves well for the electrodes in the ultrasonic transducer of the embodiment, and such a material as SUS (stainless steel), brass, iron, or nickel may be singly used therefor.

With the need for weight reduction, any desired hole processing may be executed to a glass epoxy substrate or a paper phenolic substrate that is popular for a circuit board, and the result may be subjected to plating using nickel, gold, silver, copper, and others. Herein, plating both sides of the substrate is considered effective to prevent the substrate from warping after manufactured.

When the oscillation film 12 is a two-sided electrode evaporation film or an electret film, in the ultrasonic transducer 1 of FIG. 1A, the sides of the fixed electrodes 10A and 10B facing the oscillation film 12 are required to be subjected to some insulation process, e.g., an insulation thin film process using alumina, silicon polymer, amorphous carbon film, SiO2 (silicon oxide), and others.

Described next is the oscillation film 12. The oscillation film 12 always stores thereon the electric charge of the same polarity (either positive or negative), and oscillates by the electrostatic force between the fixed electrodes 10A and 10B that show a change by an alternating voltage. By referring to FIGS. 4A to 4C, described are the specific exemplary configurations of the oscillation film 12 in the ultrasonic transducer of the embodiment of the invention.

Figure 4A:
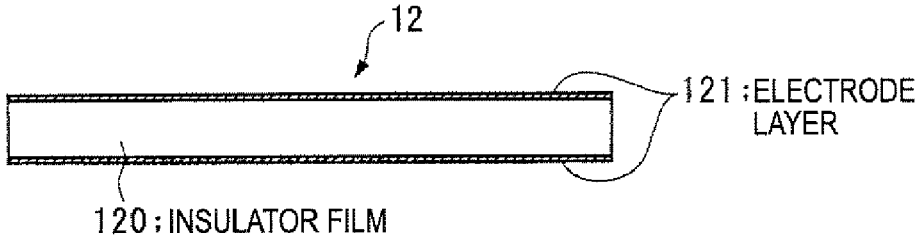
FIGS. 4A to 4C are each a diagram for illustrating a specific exemplary configuration of an oscillation film in the ultrasonic transducer in the embodiment of the invention.

FIG. 4A shows the cross sectional configuration of the oscillation film 12 formed with the electrode layers 121 after an electrode evaporation process is applied on both sides of the insulator film (insulator layer) 120. The insulator film 120 at the center is made of a polymer material, and in terms of elasticity and resistance to electrical pressure, is preferably made of polyethylene terephthalate (PET), polyester, polyethylene terephthalate (PEN), polyphenylene sulfide (PPS), and others.

The electrode evaporation material to form the electrode layer 121 is generally Al (aluminum), and for use with the polymer material and in terms of cost, the materials of Ni (nickel), Cu (copper), SUS (stainless steel), Ti (titanium), and others are considered preferable. As to the insulator polymer film as the insulator film 120 forming the oscillation film 12, it is difficult to uniquely determine the thickness because its optimum value varies due to the drive frequency, the size of the holes formed to the fixed electrodes, and others. The thickness may serve well, generally, if it is 1 μm or more but 100 μm or less.

It is considered preferable if the thickness of the electrode evaporation layer as the electrode layer 121 falls in a range from 40 nm to 200 nm. If the electrode thickness is too thin, it means that the electric charge can be hardly stored, and if the thickness is too thick, the film may get rigid and the amplitude is reduced. The possible material for the electrode includes transparent conductor film ITO (indium-tin oxide)/In (indium), Sn (tin), Zn (Zinc) oxide, and others.

Figure 4B:
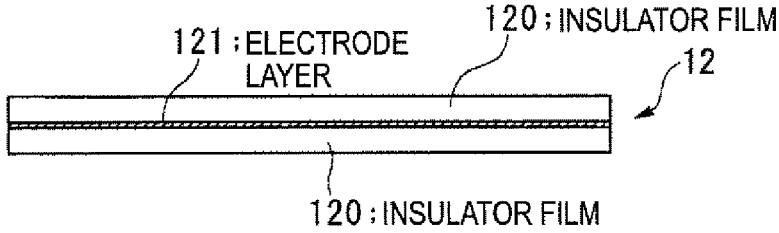

FIG. 4B shows the configuration in which the electrode layer 121 is sandwiched by insulator polymer films as the insulator films 120. Similarly to the case of FIG. 4A, the thickness of the electrode layer 121 in this case preferably falls in the range of 40 nm to 200 nm. Similarly to the two-sided electrode evaporation film of FIG. 4A, the insulator films 120 sandwiching the electrode layer 121 therebetween is preferably made of polyethylene terephthalate (PET), polyester, polyethylene naphthalate (PEN), polyphenylene sulfide (PPS), and others, and the thickness thereof is preferably 1 μm or more but 100 μm or less.

Figure 4C:
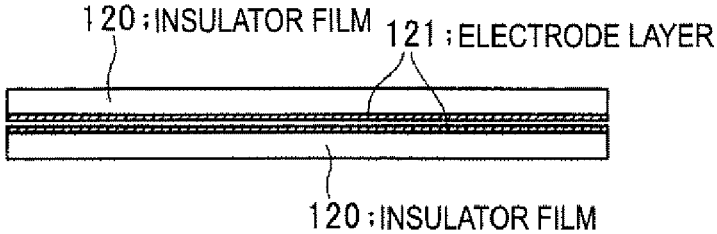

FIG. 4C shows the configuration in which two of a one-sided electrode evaporation film are attached together to make their electrode surfaces come in contact therewith. The requirements for the insulator films and the electrode portions are preferably the same as those for any other oscillation films described above.

The oscillation film 12 is required to be applied with a DOC bias voltage of several hundreds of volts. However, when the film unit is manufactured for the oscillation film 12, fixing the film under a tension of four perpendicular directions on the film surface favorably reduces the DC bias voltage.

This is aimed to derive the effects similar to the tensile tension previously taken charge by the bias voltage by applying the tension to the film in advance, and this works very effective to reduce the voltage.

For the film electrode material in this case, Al (aluminum) is most general, and for use with the polymer material and in terms of cost, the materials of Ni (nickel), Cu (copper), SUS (stainless steel), Ti (titanium), and others are considered preferable. The transparent conductor film ITO (indium-tin oxide)/In (indium), Sn (tin), Zn (Zinc) oxide, and others will also do.

For the material to fix the fixed electrodes or the oscillation film, the plastic material is considered preferable in view of light weight and nonconductivity, e.g., acryl, Bakelite, or polyacetal (polyoxymethylene) resin (POM).

Described next is the configuration of main components in the electrostatic ultrasonic transducer in the embodiment of the invention. As described above by referring to FIGS. 2A to 3C, in the configuration of the fixed electrode, the length t is so determined that the thickness of the fixed electrode configures a resonance tube being an acoustic tube that causes a resonance phenomenon (refer to FIGS. 2A to 2C).

FIG. 5 is a plane view of the fixed electrode (resonance tube unit) 10A (10B) formed with the through holes (resonance tubes) 14, and showing an exemplary placement of the through holes formed to the fixed electrode 10A (10B). The placement of the through holes is not necessarily regular as shown in FIG. 5.

In terms of configuration, the length of the through holes is mainly the length t of the thick portion of the fixed electrode. Therefore, to use the through hole portion of the fixed electrode as a resonance tube, the length t of the thick portion of the fixed electrode is required to be determined to configure a resonance tube.

FIGS. 6A and 6B are each a cross sectional diagram, viewed from the front, showing the resonance state of audio in the fixed electrode serving as a resonance tube unit being a cluster of the resonance tubes. In the drawings, a reference character t denotes the length of a resonance tube, and this example shows the state in which the acoustic wave of a half wavelength is transmitted.

The minimum wavelength unit causing a resonance phenomenon is a half wavelength, and the theoretical equation of the resonance phenomenon at both aperture ends is as follows. That is, $\lambda=mc/f$ (equation 1) (where f is a frequency of ultrasound, c is the speed of sound (about 340 m/s), $\lambda$ is a wavelength, and m is an integer).

Here, assuming that the optimum length of an acoustic tube is $\lambda opt$, and n is an odd natural number, the length is expressed as $$\lambda opt=(nc/4)\lambda \quad \text{(equation 2).}$$

When the wavelength $\lambda$ of the acoustic wave satisfies the equation 2, the sound pressure is maximized at the exit port of the acoustic tube, and this is the asking length of an acoustic tube (resonance tube), i.e., the length t of the thick portion of the fixed electrode. Accordingly, FIG. 6B shows the configuration with which the resonance tube unit, i.e., the fixed electrode, is most compact in size. In the drawing, the length t may take any number as long as being a positive natural number multiple of a quarter wavelength.

As an example, when the frequency of ultrasound is 40 kHz, the wavelength is 8.5 mm. The length t of a resonance tube (thickness of a fixed electrode) may be of 2.125 mm, a quarter of the wavelength. With the ultrasound for generation, if with 20 kHz as a reference, the wavelength is 17 mm. Accordingly, the length t of a resonance tube (thickness of a fixed electrode) may be 4.25 mm, a quarter of the wavelength.

If with 100 kHz as a reference, the wavelength is 3.4 mm. Accordingly, the length t of a resonance tube (thickness of a fixed electrode) may be 0.85 mm, a quarter of the wavelength.

In reality, as shown in the following equation 3, the length t of the thick portion of a fixed electrode may have a range of choices of some degree.

$$(\lambda/4)\cdot n-\lambda/8\leqq t\leqq(\lambda/4)\cdot n+\lambda/8 \quad \text{(equation 3)}$$

where $\lambda$ denotes a wavelength of ultrasound (Hz), and n denotes a positive odd number.

$$\lambda=c/f \quad \text{(equation 4)}$$

will be also do, where c denotes the speed of sound, c=331.3+0.6T (m/s), where T denotes the temperature of air (degrees), and f denotes the frequency of ultrasound (Hz).

The equation 3 means that the length of a resonance tube (thickness of a fixed electrode) is selected from a range covering the optimum value for the length in the neighborhood of ±⅛ wavelength. The ⅛ wavelength is equivalent to about 70% of the optimum value, and a value more than that is estimated as causing no big loss in terms of efficiency even if it is selected.

Note that, in this embodiment, in FIG. 1A, there is actually a slight space between the bottom portion of the fixed electrode (resonance tube unit) 10A and the oscillation film, i.e., the drawing shows intimate contact with no space therebetween. This space is provided for correction of an aperture end, and is generally required to be 0.6 to 0.85 times of the radius of a resonance tube.

With such a principle, the inner diameter of a resonance tube is assumed as being sufficiently smaller than the acoustic wavelength, and a plane wave is expected to be generated in the tube. With the electrostatic ultrasonic transducer in the embodiment of the invention, the ultrasonic to be generated is a plane wave, and the inner diameter of a tube is about 2.1 mm at the maximum. This is sufficiently a small value in consideration of the wavelength of 17 mm when the frequency of the ultrasound to be oscillated as a carrier wave is 20 kHz so that it is considered no problem.

As such, with the electrostatic ultrasonic transducer in the embodiment of the invention, the thickness of the fixed electrode in the electrostatic ultrasonic transducer of Push-Pull type is so set that the through holes formed to the fixed electrode function as resonance tubes by utilizing the sound resonance phenomenon. This enables to generate more intense ultrasound under the same drive conditions as with others. In other words, the sound pressure of the same level can be generated with less electric energy in the electrostatic ultrasonic transducer of Push-Pull type so that the voltage (power) can be favorably reduced.

By referring to FIG. 7, described next is the configuration of an ultrasonic transducer in another embodiment of the invention. The configuration of an ultrasonic transducer 55 in this embodiment is the same as that of FIG. 1A, except that the acoustic reflector plate is disposed on the rear surface of the ultrasonic transducer. That is, the ultrasonic transducer 55 in this embodiment is configured to include the pair of electrodes 10A and 10B, the oscillation film 12, and a member (not shown) for keeping hold of the fixed electrodes 10A and 10B and the oscillation film 12. The fixed electrodes 10A and 10B each include a conductor member that is made of a conductor material and serves as an electrode. The oscillation film 12 is sandwiched between the fixed electrodes 10A and 10B, and is provided with the electrode layer 121. The oscillation film 12 is applied with a DC bias voltage. The fixed electrode 10A is formed with a plurality of through holes 14 at positions opposing to those of the fixed electrode 10B via the oscillation film 12. The fixed electrode 10A has the through holes 14 as many as those of the fixed electrode 10B. Between the conductor member of the fixed electrode 10A and that of the fixed electrode 10B, alternating signals are applied. On the rear surface of such an ultrasonic transducer, an acoustic reflector plate 200 is disposed. Similarly to the above embodiment, the length t of the thick portions of the through holes formed to the electrodes 10A and 10B is made equal, and the through holes are made to serve as resonance tubes.

The acoustic reflector plate 200 is so disposed that the ultrasound emitting from aperture portions on the rear surface of the ultrasonic transducer 55 is directed toward the front surface of the ultrasonic transducer 55 through paths of the same length.

That is, the acoustic reflector plate 200 is provided with two of a first reflector plate 201 whose one end is positioned at a center position M of the rear surface of the ultrasonic transducer 55 with an angle of 45 degrees against the rear surface thereof relative to the center position M. Each of the first reflector plates has a length that extends to a point at which one end thereof matches the end portions of X1 and X2 of the electrostatic ultrasonic transducer 55. The acoustic reflector plate 200 is also provided with two of a second reflector plate 202 that is connected to the first reflector plates 201 in an outer direction with an angle of 90 degrees against the end portions of the first reflector plates, and has the length similar to that of the first reflector plates.

With such a configuration, the first reflector plates 201 and 201 are each disposed with an angle of 45 degrees on the rear surface of the ultrasonic transducer 55 relative to both sides of the center position M. The first reflector plates 201 and 201 are each required to have a length that extends to a point at which one end thereof matches the end portions of the electrostatic ultrasonic transducer 55. With such first reflector plates 201 and 201, the ultrasound emitted from the rear surface of the ultrasonic transducer 55 is reflected in the horizontal direction.

With the second reflector plates 202 and 202 that are connected to the first reflector plates 201 and 201 in an outer direction with an angle of 90 degrees, the ultrasound is directed to the front surface of the ultrasonic transducer 55 from its sides or upper or lower portion thereof. These second reflector plates are required to have the length similar to that of the first reflector plates. Herein, it is important that the ultrasound emitted from the rear surface of the ultrasonic transducer 55 share the same length of path. This is because having the same length of path means the ultrasound emitted from the rear surface having the same phase.

Figure 7:
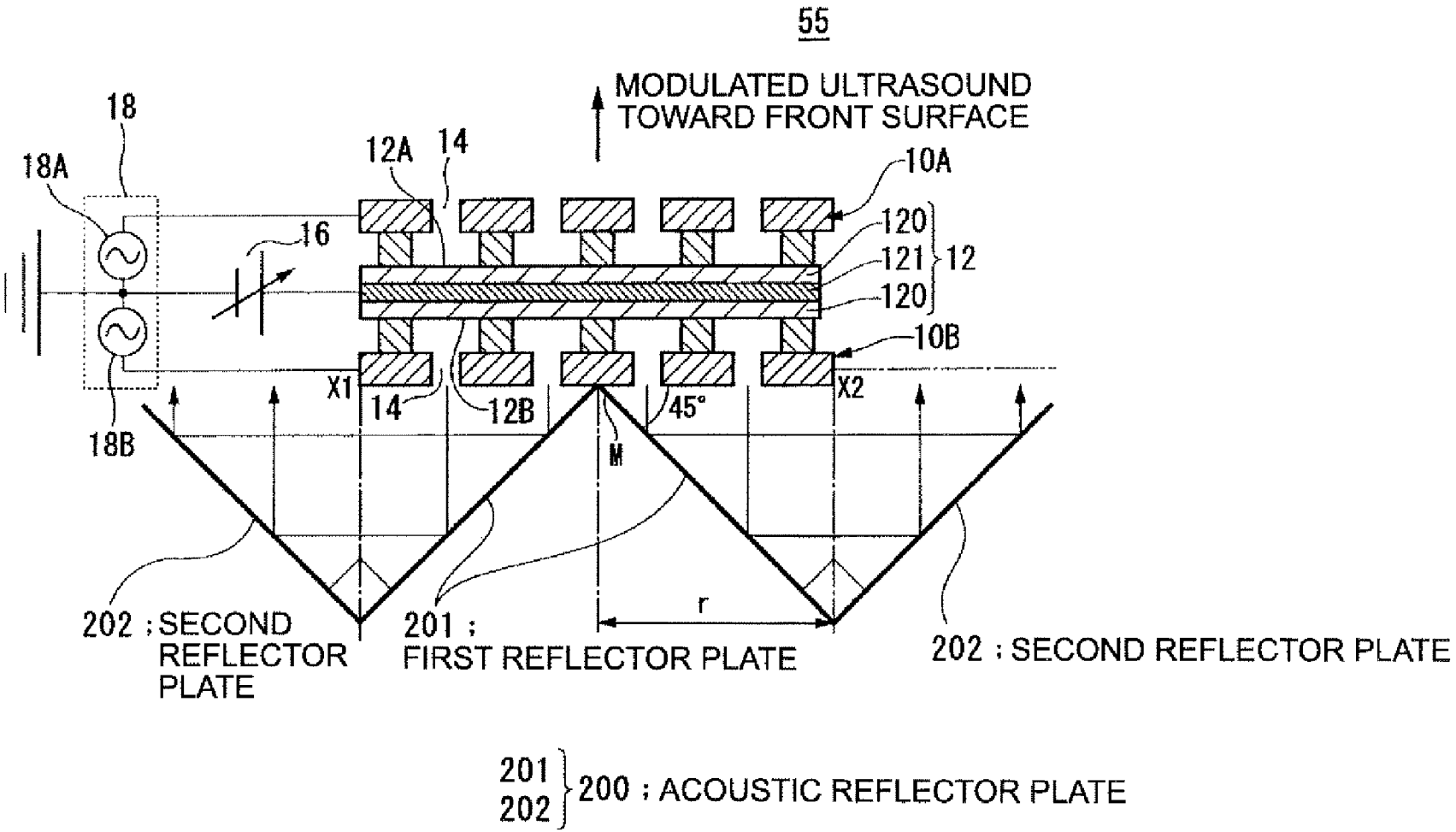
FIG. 7 is a diagram showing the configuration of an ultrasonic transducer in another embodiment of the invention.

Moreover, the reason why the acoustic waves can be handled geometrically as shown in FIG. 7 is that the emitting acoustic waves have considerably strong directivity as is ultrasound. Further, there needs to refer to the time difference between the ultrasound emitted from the front surface of the ultrasonic transducer 55 and the ultrasound that is directed toward the front surface after being reflected by the rear surface.

With an assumption that the transducer is formed circular, and the radius thereof is r, the ultrasound emitted from a point being away from the center of the transducer by the distance a covers the distance of about 2r before reaching the front surface of the transducer, i.e., covers the distance equal to the diameter of the transducer. Here, the distance a is surely required to satisfy the following equation.

$$0 \leqq a \leqq r \qquad \text{(equation 1)}$$

Assuming that the diameter of the transducer is about 10 cm and the speed of sound is 340 m/sec, the time difference is about 0.29 msec between the time taken for the ultrasound emitted from the front surface and the time taken for the ultrasound to reach the front surface after being reflected by the rear surface. This value is a time difference the human beings cannot perceive so that there is no problem. That is, the ultrasound emitted from the front and rear surfaces of the transducer can be both effectively utilized.

Figure 8:
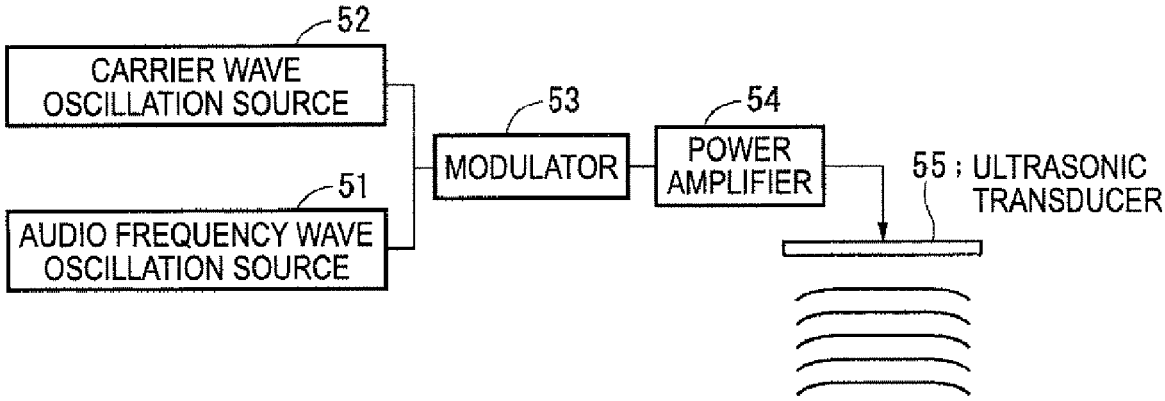
FIG. 8 is a block diagram showing the configuration of an ultrasonic speaker in the embodiment of the invention.

FIG. 8 shows the configuration of an ultrasonic speaker in the embodiment of the invention. In the ultrasonic speaker of the embodiment, the electrostatic ultrasonic transducer in the above-described embodiment of the invention (FIG. 1A) is used as the ultrasonic transducer 55.

In FIG. 8, the ultrasonic speaker of the embodiment is configured to include: an audio frequency wave oscillation source (signal source) 51 that generates signal waves in an audio frequency band; a carrier wave oscillation source (carrier wave supply unit) 52 that generates and outputs carrier waves in an ultrasonic frequency band; a modulator (modulation unit) 53; a power amplifier 54, and the ultrasonic transducer 55.

The modulator 53 modulates the carrier waves coming from the carrier wave oscillation source 52 using the signal waves in the audio frequency band provided by the audio frequency wave oscillation source 51, and supplies the modulation result to the ultrasonic transducer 55 via the power amplifier 54.

With such a configuration, the carrier waves in the ultrasonic frequency band coming from the carrier wave oscillation source 52 are modulated by the modulator 53 using the signal waves provided by the audio frequency wave oscillation source 51, and the modulation signal through with amplification by the power amplifier 54 is used to drive the ultrasonic transducer 55. As a result, the modulation signal is converted into the acoustic waves of a limited amplitude level by the ultrasonic transducer 55, and the acoustic waves are emitted into a medium (into the air) so that the signal sound in the original audio frequency band is self-reproduced due to the nonlinear effects of the medium (air).

That is, because the acoustic wave is a compressional wave being transmitted with a medium of air, in the course of transmission, the modulated ultrasound is affected by the apparent difference of air density, i.e., the air is dense in some portion, and not in dense in other portions. This causes an increase of the speed of sound in the air-dense portion, and a decrease in the no-air-dense portion. As a result, the modulation wave itself suffers from distortion, and is subjected to curve fitting to derive a carrier wave (ultrasonic frequency band). As such, a signal waves (signal sound) in the audio frequency band is reproduced.

With the high sound pressure ensured for a wide range of frequency, the ultrasonic speaker can be used as a speaker for various applications. The ultrasound is easily attenuated in the air, and is attenuated in proportion to the square of the frequency thereof. Accordingly, the low carrier frequency (ultrasound) reduces the attenuation, and the resulting ultrasonic speaker can thus provide sound far away in beam.

On the other hand, the high carrier frequency increases the attenuation, and thus the parametric array effects are not derived sufficiently. The resulting ultrasound speaker can thus provide sound with a wide angle. This is considered very effective because it means that a single piece of ultrasonic speaker can be used for different purposes and applications.

Dogs popularly living with human beings as pets can hear audio up to 40 kHz, and cats can hear audio up to 100 kHz. In consideration thereof, using the carrier frequency higher than such values advantageously eliminates the possibility of affecting the pets. In any case, the speaker applicable with various ranges of frequencies favorably produces various many advantages.

The ultrasonic speaker of the embodiment can generate an acoustic signal of a sound pressure level sufficiently high to derive the parametric array effects over a wide range of frequency.

Further, in the ultrasonic speaker of the embodiment, used is an electrostatic ultrasonic transducer in which a pair of fixed electrodes each have a thickness t of about $(\lambda/4)\cdot n$ (where $\lambda$ denotes a wavelength of ultrasound, and n denotes a positive odd number) or $(\lambda/4)\cdot n-\lambda/8 \leqq t \leqq (\lambda/4)\cdot n+\lambda/8$ (where $\lambda$ denotes a wavelength of ultrasound, and n denotes a positive odd number). This allows the thickness of each of the electrodes of a portion formed with the through hole configures a resonance tube so that the sound pressure can be maximized in the vicinity of an exit port of the fixed electrode. As such, this enables to generate more intense ultrasound under the same drive conditions as with others.

Description about Manufacturing Method of Fixed Electrode for Use in Electrostatic Ultrasonic Transducer of Invention Described next is a manufacturing method of a fixed electrode portion for use in the electrostatic ultrasonic transducer of Push-Pull type of the invention.

Figure 19:
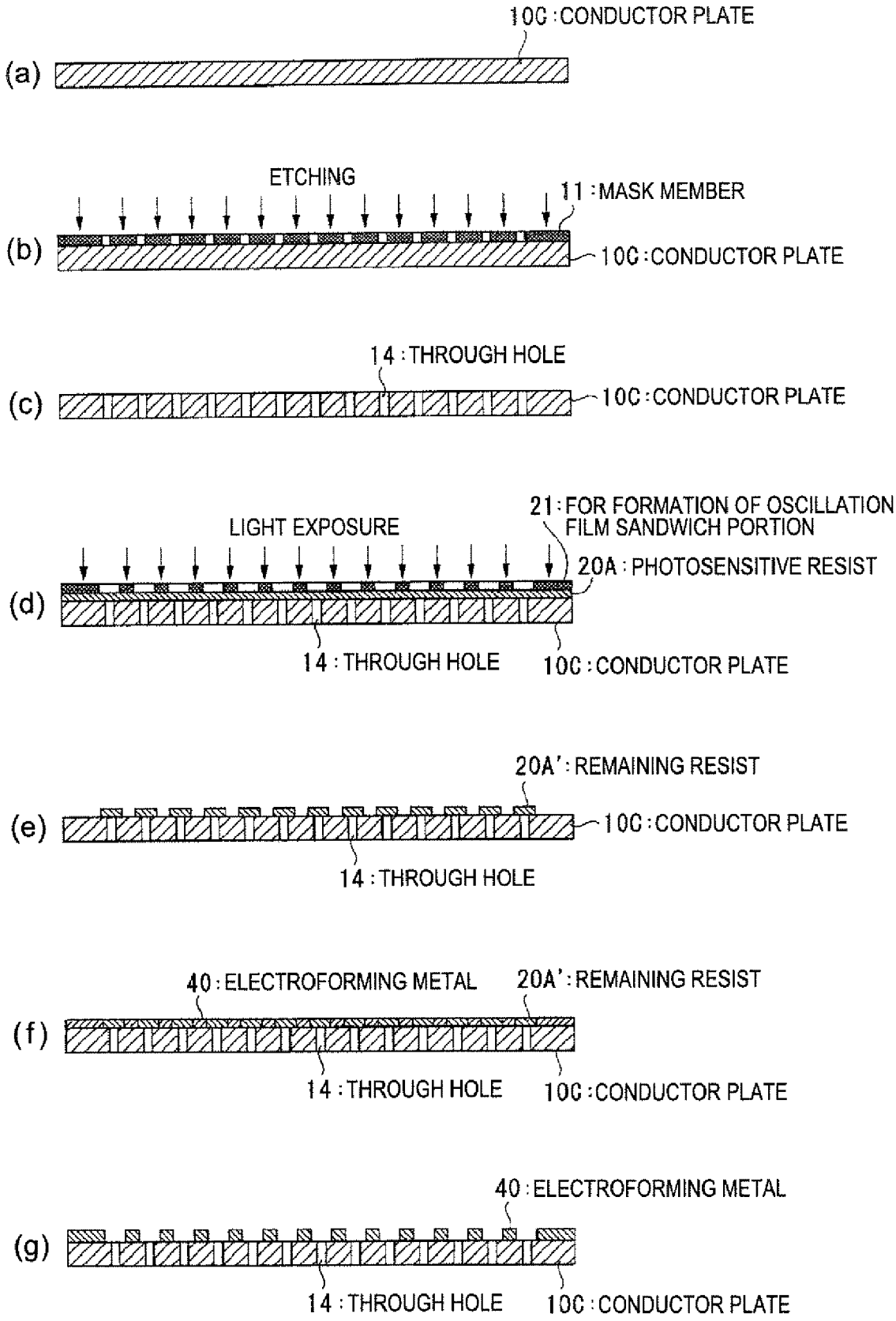
FIGS. 19A to 19G are diagrams showing the manufacturing procedure in the previous ultrasonic transducer manufacturing method.

By referring to FIGS. 19A to 19G, first described is a manufacturing procedure in a case of manufacturing, in the previous manner, a fixed electrode portion of an ultrasonic transducer by photolithography. In the drawing, a conductor plate 10C is covered by a mask member 11 formed with a pattern of a plurality of through holes, and the conductor plate 10C is formed with through holes 14 by etching (FIGS. 19A and 19B). Herein, the conductor plate 10C is often made of copper or stainless, and if for nickel electroforming, the plate is suitably made of copper.

After the conductor plate 10C is formed with the through holes 14, the mask member 11 is peeled off so that the resulting conductor 10C is punched with the through holes 14 (FIG. 19C).

The bore of the through holes 14 punched in the conductor plate 10C by etching has limits associated with the thickness of the conductor plate 10C. Assuming that the minimum bore of the through holes 14 in the ultrasonic transducer of the embodiment is 0.25 mm, the thickness of the plate formed with such through holes 14 is limited to be 0.25 mm or thinner. Accordingly, if a fixed electrode is required to have the thickness of 0.25 mm or more, a metal plate of 0.25 mm in thickness may be plurally prepared for stacking as many as required to derive a fixed electrode of any desired thickness. The metal plates are those each formed with the through holes 14 by etching, and are stacked together by metal coupling, i.e., thermocompression bonding or diffused junction.

With this being the case, the fixed electrode is so configured as to have the thickness t of about $(\lambda/4)\cdot n$ (where $\lambda$ denotes a wavelength of ultrasound, and n denotes a positive odd number) or $(\lambda/4)\cdot n-\lambda/8 \leqq t \leqq (\lambda/4)\cdot n+\lambda/8$ (where $\lambda$ denotes a wavelength of ultrasound, and n denotes a positive odd number). That is, the thickness of the fixed electrode of a portion formed with the through hole configures a resonance tube.

Next, the conductor plate 10C punched in the through holes 14 (or the conductor plate as a result of plate stacking) is formed with an oscillation film sandwich portion (height different portion) configuring the fixed electrode. For the purpose, the conductor plate 10C is coated by a photosensitive resist 23 as preprocessing, i.e., coated if with a liquid resist, and laminated if with a film resist. The conductor plate 10C is then covered by a mask member 21 for forming the oscillation film sandwich portion, and the resulting plate is exposed to light (FIG. 19D).

The photosensitive resist 23 is often a liquid resist or a dry film to form a temporary intermediate structure by etching, plating, or others. In this example, because the photosensitive resist 23 is expected to seal the through holes 14, using a dry film is considered more effective.

After any unnecessary resist is removed by developing, exposed is only the surface of the conductor plate 10C of a portion to which the oscillation film sandwich portion (height different portion) is formed for the fixed electrode (FIG. 19E).

On the exposed surface of the conductor plate 10C, a metal, e.g., nickel, is stacked by electroforming until the height reaches any desired value (FIG. 19F). After such electroforming, peeling a remaining resist 24 favorably leads to any desired fixed electrode (FIG. 19G).

Described now are problems observed in the fixed electrode manufactured by such a previous manufacturing procedure.

1. Oscillation Film Cannot be Too Thin

When a fixed electrode is manufactured in the previous manufacturing procedure as described above, i.e., when an oscillation film sandwich potion is made of a conductor material for a fixed electrode, the maximum clearance between the metal evaporation layer, i.e., conductor layer, of the oscillation film and the fixed electrode will be the thickness of the insulator layer of the oscillation film.

Herein, the insulator layer of the oscillation electrode film for use in the ultrasonic transducer of the embodiment is made of PET (polyethylene terephthalate), polyphenylene sulfide (PPS), polypropylene (PP), polyimide (PT), and others.

Here, the dielectric breakdown strength is as follows for the respective materials.

PET, PPS, PI: 200 V/μm

PP: 300 V/μm

The voltage to be applied to the transducer is of several hundreds of V to several kV for both of the fixed electrode and the oscillation electrode film.

Therefore if the insulator layer of the oscillation film is made of PET in the previous configuration, for example, the film thickness is required to be at least 10 μm for voltage application of 2 kV. It means that the film thinner than 10 μm cannot be used as an oscillation film.

2. Likely to Cause Dielectric Breakdown

The fixed electrode formed by etching is very sharp at its edge portion, and any portion subjected to additional processing, i.e. mechanical processing, is left with burrs of a few to several tens of microns, for example. It is understood that the metal through with etching easily suffers from distortion, and even with thermocompression bonding or diffused junction, the burrs of at least several tens of μm are left.

Figure 20:
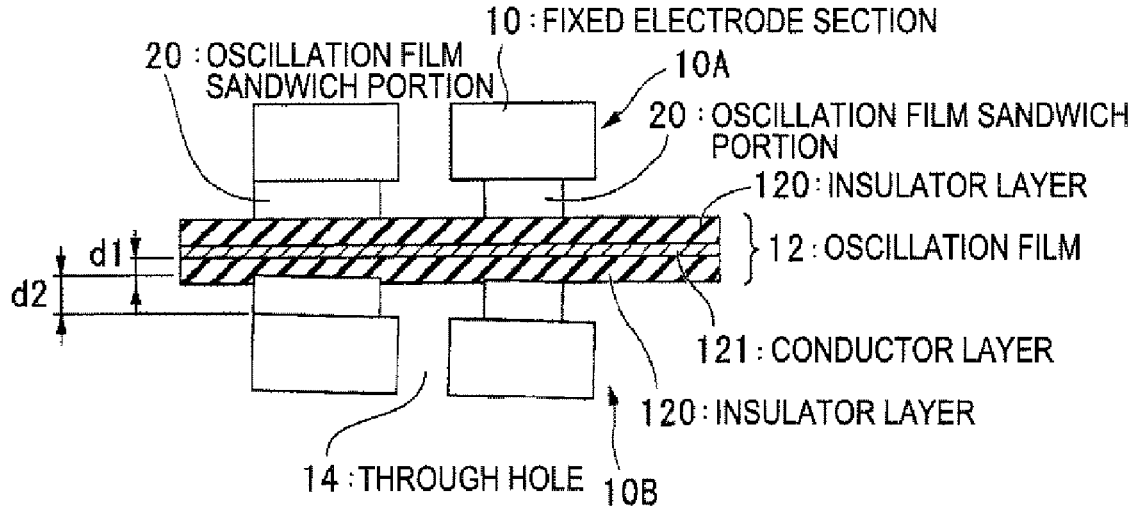
FIG. 20 is a diagram showing the configuration problems of the ultrasonic transducer manufactured by the previous manufacturing method.

As such, to make the deformed fixed electrodes sandwich the oscillation electrode film therebetween with reliability, as shown in FIG. 20, the edge portion of the oscillation film sandwich portion 20 in the fixed electrode digs into the insulator film 120 of the oscillation film 12.

With the previous configuration, the oscillation film sandwich portion 20 is made of a conductor material so that the minimum gap is d1 in the drawing between the electrode layer 121 of the oscillation film 12 and the conductor section of the fixed electrode. As such, the gap is reduced by the digging portion, resulting in the reduction of the dielectric breakdown strength.

In an exemplary case where the insulator layer 120 is made of PET, if the gap d1 is reduced down to about 1 μm, this results in a difficulty of voltage application of 200 V or higher.

3. Larger Capacitance Results in Wasting Energy

The power application is determined by the capacitance, and as the gas becomes narrower between the electrode layer 121 of the oscillation film 12 and the fixed electrode, i.e., as the insulator layer 120 of the oscillation electrode film is getting thinner, the capacitance is increased so that the power application is also increased.

On the other hand, the electrostatic force acting on the oscillation film 12 and mostly affecting the main characteristics, i.e., the sound pressure, of the ultrasonic transducer is determined by the metal surface area of the fixed electrode exposing as an oscillation film sandwich portion, and the height difference of the oscillation film sandwich portion, i.e., gap between the conductor and the oscillation film.

It means that an oscillation film with a thinner insulator film increases the electrostatic force, but also increases the capacitance. This is thus considered not preferable in terms of energy efficiency.

As described in the foregoing, a fixed electrode manufactured with the previous manufacturing method for use in the ultrasonic transducer have problems of: the oscillation film cannot be too thin; it is likely to cause dielectric breakdown between the fixed electrode and the conductor layer of the oscillation film; the capacitance is large between the conductor layer of the oscillation film and the fixed electrode, thereby resulting in wasting energy.

These problems are successfully solved by an ultrasonic transducer manufacturing method that will be described below.

First Embodiment

Fixed Electrode Manufacturing Method for Use in Electrostatic Ultrasonic Transducer of Invention FIGS. 9A to 9E show a first embodiment of a fixed electrode manufacturing method for use in the electrostatic ultrasonic transducer of the invention.

Figure 9:
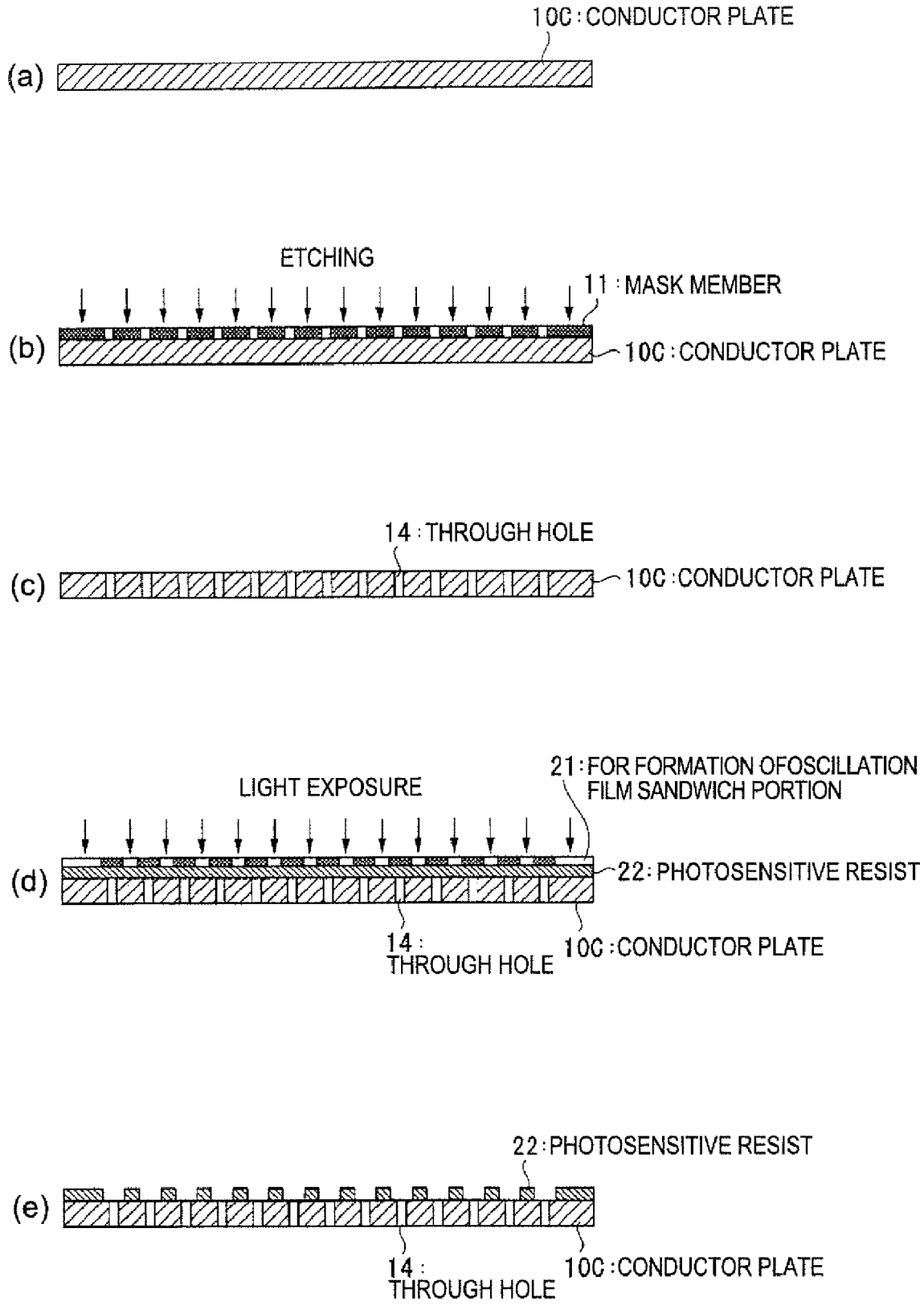
FIGS. 9A to 9E are diagrams showing a first embodiment of an ultrasonic transducer manufacturing method.

In FIGS. 9A to 9E, first of all, the conductor plate 10C is covered by the mask member 11 formed with a pattern of a plurality of through holes, and the conductor plate 10C is formed with the through holes 14 by etching (FIGS. 9A and 9B). Herein, the conductor plate 10C is often made of copper or stainless, and if for nickel electroforming, the plate is suitably made of copper.

After the conductor plate 10C is formed with the through holes 14, the mask member 11 is peeled off so that the resulting conductor plate 10C is punched with the through holes 14 (FIG. 90C). The resulting conductor plate 10C is then stacked with others to have the thickness t of about $(\lambda/4)\cdot n$ (where λ denotes a wavelength of ultrasound, and n denotes a positive odd number) or $(\lambda/4)\cdot n-\lambda/\leqq t\leqq(\lambda/4)\cdot n+\lambda/8$ (where λ denotes a wavelength of ultrasound, and n denotes a positive odd number) for the resulting stack of the conductor plates. If such a thickness is derived only with a single piece of conductor plate 10C, there is surely no need to stack together the conductor plate 10C.

Next, the conductor plate 10C punched in the through holes 14 (or the conductor plate as a result of plate stacking) is formed with a height difference configuring an oscillation film sandwich portion. For the purpose, the conductor plate 10C is coated by a photosensitive resist 22, i.e., coated if with a liquid resist, and laminated if with a film resist. The conductor plate 10C is then covered by the mask member 21 for forming the oscillation film sandwich portion, and the resulting plate is exposed to light (FIG. 9D).

The photosensitive resist 22 as a material for forming the oscillation film sandwich portion is expected to permanently serve as the oscillation film sandwich portion, and has to be nonconductive. The possibly effective material includes, as a liquid resist, a photosensitive polyimide coating material, being a photosensitive coating material for use in semiconductor manufacturing, and is used to coat a metal plate by spin coating. As a film resist, a photosensitive solder resist film or a photosensitive polyimide film will do, which are used for circuit board packaging.

After the mask member 21 for forming the oscillation film sandwich portion is peeled off, and after any unnecessary photosensitive resist 22 is removed by developing, only the surface of the conductor plate 10C serving as a fixed electrode portion is exposed. The nonconductive photosensitive resist 22 remains on other portions so that any desired fixed electrode is completed (FIG. 9E).

In the fixed electrode manufacturing method for use in the ultrasonic transducer including such a procedure, the oscillation film sandwich portion for the fixed electrodes to sandwich the oscillation film therebetween is made of an insulator material by photolithography. This accordingly shortens the manufacturing procedure because the previously-required procedure after metal electroforming is no more required, thereby reducing the manufacturing cost. This also eliminates the solution or others for use to peel off any remaining resist, e.g., strong alkali solution, so that this serves well in terms of environmental protection.

Second Embodiment

Fixed Electrode Manufacturing Method for Use in Electrostatic Ultrasonic Transducer of Invention (Screen Printing)

FIGS. 10A to 10E show a second embodiment of the fixed electrode manufacturing method (manufacturing process) for use in the electrostatic ultrasonic transducer of the invention.

Figure 10:
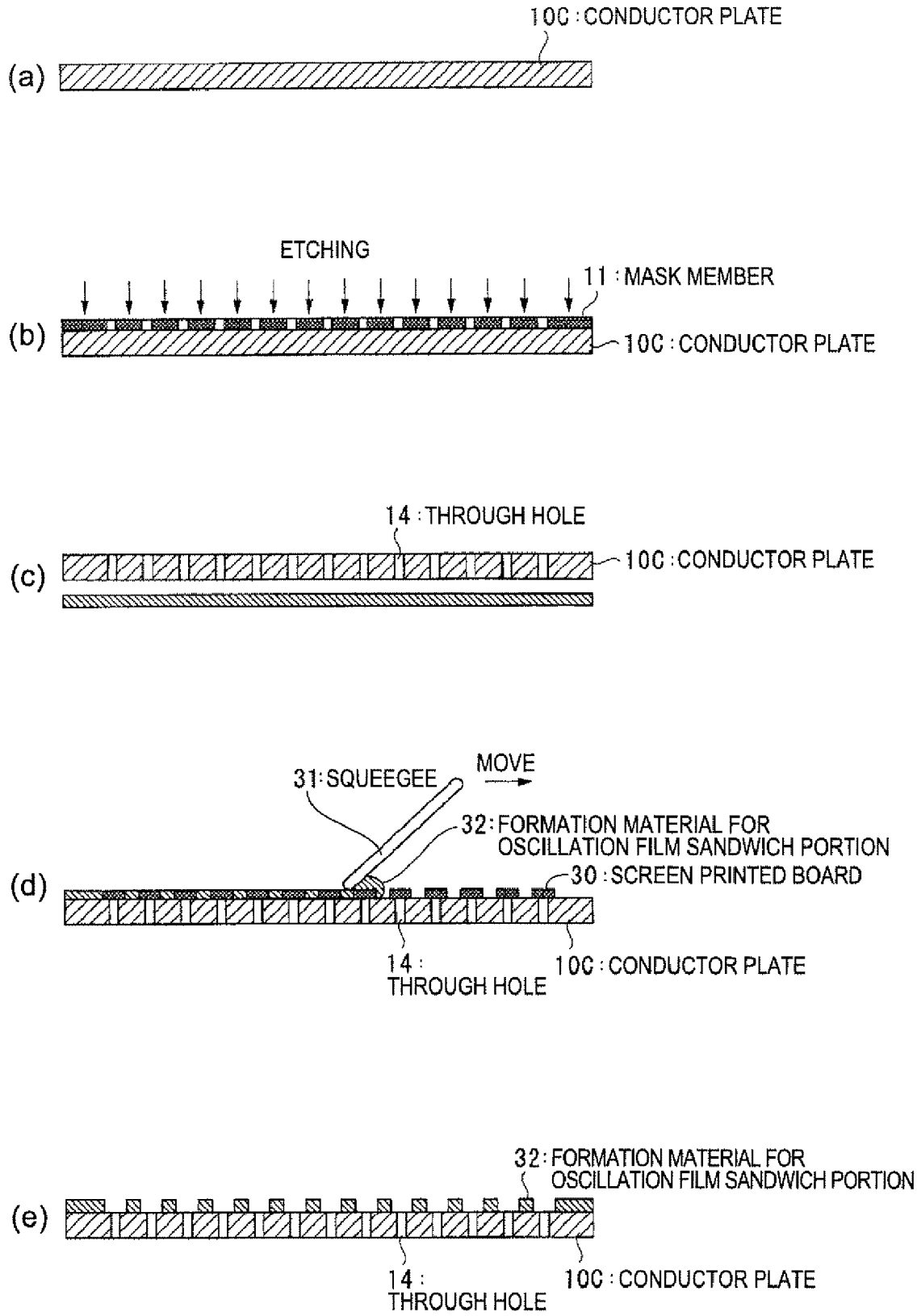
FIGS. 10A to 10E are diagrams showing a second embodiment of the ultrasonic transducer manufacturing method.

In FIGS. 10A to 10E, first of all, the conductor plate 10C is covered by the mask member 11 formed with a pattern of a plurality of through holes, and the conductor plate 10C is formed with the through holes 14 by etching (FIGS. 10A and 10B). Herein, the conductor plate 10C is often made of copper or stainless, and if for nickel electroforming, the plate is suitably made of copper.

After the conductor plate 10C is formed with the through holes 14, the mask member 11 is peeled off so that the resulting conductor plate 10C is punched with the through holes 14 (FIG. 10C). The resulting conductor plate 10C is stacked with others to have the thickness t of about $(\lambda/4)\cdot n$ (where λ denotes a wavelength of ultrasound, and n denotes a positive odd number) or $(\lambda/4)\cdot n-\lambda/8\leqq t\leqq(\lambda/4)\cdot n+\lambda/8$ (where λ denotes a wavelength of ultrasound, and n denotes a positive odd number) for the resulting stack of the conductor plates. If such a thickness is derived only with a single piece of conductor plate 10C, there is surely no need to stack together the conductor plate 10C.

Next, on the conductor plate 10C punched in the through holes 14 (or the conductor plate as a result of plate stacking), a screen printed board 30 and a liquid formation material 32 for forming an oscillation film sandwich portion are set to form an oscillation film sandwich portion to the fixed electrode. Thereafter, a squeegee 31 is moved to coat the formation material 32 to the portion of the screen printed board 30 not covered by the mask member (FIG. 10D).

Here, the possibly effective formation material 32 for an oscillation film sandwich portion is expected to permanently serve as an oscillation film sandwich portion, and has to be nonconductive, including a solder resist in liquid generally used for circuit board packaging, a masking ink for use as a resist for sandblasting, and others. The solder resist specifically for use with a flexible printed board is relatively soft, i.e., about HB to 3H with pencil hardness, and thus it is considered effective to securely keep hold of the oscillation electrode film.

After the formation material 32 for an oscillation film sandwich portion is coated to the portion of the screen printed board 30 not covered by the mask member, the screen printed board 30 is removed. After such board removal, the nonconductive layer, i.e., the formation material 32 for an oscillation film sandwich portion, is left on the oscillation film sandwich portion of the conductor layer 10C. Thus left layer is then dried so that any desired fixed electrode is completed (FIG. 10E).

As such, by forming the oscillation film sandwich portion of the fixed electrode using an insulator material by screen printing, the previously-required procedure after metal electroforming is favorably eliminated, and such operation as developing is not needed at all for photolithography so that the manufacturing procedure can be considerably reduced, and the manufacturing cost can be greatly reduced.

In another possible ultrasonic transducer manufacturing method, a resist is previously formed in such a manner that a conductor section is exposed only from the portion to be coated, and a nonconductive ink (nonconductive coating material) is coated through dissipation using an inkjet head. Alternatively, the plate may be immersed in a polyimide material for electrodeposition coating, and after the material is coated or electro-deposited thereby, the resist may be peeled off.

As described in the foregoing, by forming an oscillation film sandwich portion of a fixed electrode for use in an electrostatic ultrasonic transducer using a nonconductive material, i.e., insulator material, the following effects are achieved.

1. Wider Selection Range for Film Thickness of Oscillation Film

The insulator layer is increased in thickness by the height difference, i.e., a few μm to several tens of μm, of the oscillation film sandwich portion made of a nonconductive material for a fixed electrode. This allows the use of a thin film of 10 μm or less as an oscillation film under high voltage.

As an example, if the insulation layer of the oscillation electrode film is a PET film of 3 μm in thickness, with fixed electrodes configured in the previous manner, i.e., fixed electrodes are entirely formed by a conductor material, the upper limits for the applicable voltage is 600V. On the other hand, with fixed electrodes made of a nonconductive material, when oscillation film sandwich portion has a height difference of 3 μm, for example, the clearance will be 6 μm between the fixed electrode surface and the conductor layer of the oscillation film. This enables voltage application of 1 kV or higher.

As another example, for voltage application of 3 kV with the oscillation film sandwich portion having a height difference of 20 μm in the fixed electrode, the fixed electrode configured by the previous manner requires an insulator layer (made of PET) of 15 μm. In such a case, with the oscillation film sandwich portion made of a nonconductive material in the fixed electrode, a PET film of 1 μm will serve sufficiently for use (clearance of 21 μm).

2. Possible Prevention of Dielectric Breakdown Between Fixed Electrode and Conductive Layer of Oscillation Film Even if Oscillation Film is Damaged When the oscillation film sandwich portion 20 of each of the fixed electrodes 10A and 10B is made of a nonconductive material, in FIG. 20, a height difference d2 of the oscillation film sandwich portion 20, i.e., a few μm to several tens of μm, is additionally provided to serve as an insulator layer. As a result, the minimum gap will be (d1+d2) between the electrode layer 121 of the oscillation film 12 and the fixed electrode portion (conductor section) of the fixed electrode 10. Accordingly, even if the edge portion digs deep in the insulator layer 120 of the oscillation film 12, the dielectric breakdown strength can be remained with a sufficient level. This successfully prevents any previously-observed problems from occurring, and a thin oscillation electrode film serves well with no problem.

Even if the fixed electrode 10A or 10B fully abuts the electrode layer 121 of the oscillation film 12, or completely protrudes from the oscillation film 12 and abuts the opposite fixed electrode, the conductor sections never come into contact with each other. This thus completely prevents the reduction of the insulating strength and the short circuit that are often caused by the fixed electrodes distorted in structure.

3. Possible Improvement of Energy Efficiency by Reduced Capacitance

Compared with any previous fixed electrodes entirely made of a conductor material, if an oscillation film sandwich portion is made of a nonconductive material, this produces an advantage of reducing only the capacitance between the conductor section of the fixed electrode (fixed electrode section 10) without changing at all the electrostatic force acting on the oscillation film.

Figures 11A, 11B, 12:
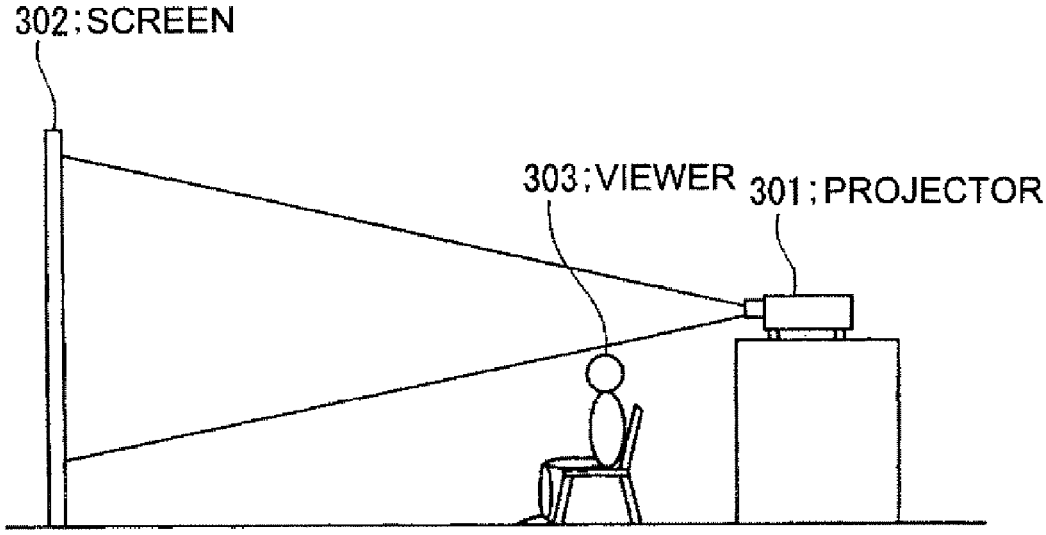
FIGS. 11A and 11B are each a diagram showing the relationship among the thickness of an insulator layer of the oscillation film, the thickness of an oscillation film sandwich portion, and the capacitance.
FIG. 12 is a diagram showing the usage state of a projector in the embodiment of the invention.
Figure 21:
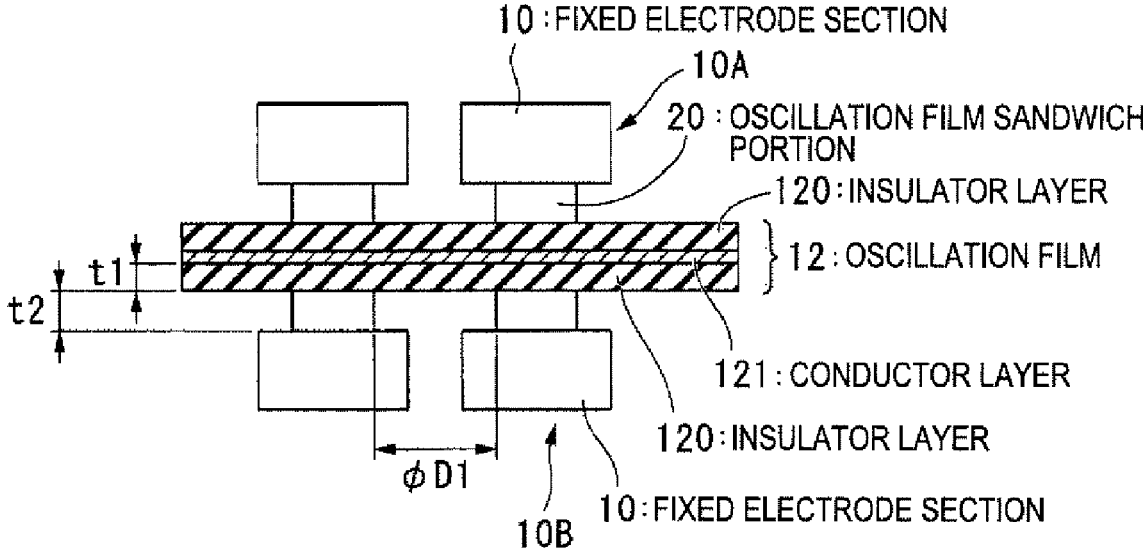
FIG. 21 is a diagram for illustrating the property improvement achieved by the manufacturing method of the invention.

For example, FIGS. 11A and 11B show the ratio of a capacitance in the configuration of the transducer of the invention (FIG. 21) compared with the configuration of the previous fixed electrodes. Exemplified here is a case where the insulator layer 120 of the oscillation film 12 is made of PET (dielectric constant of 3.2), and the thickness thereof is t1. The oscillation film sandwich portion 20 is made of polyimide (dielectric constant of 3.5), and the thickness thereof, i.e., height difference of the oscillation film sandwich portion 20, is t2. The outer diameter of the oscillation film sandwich portion 20 is ϕD1, and the inner diameter is a half of the outer diameter.

As is evident from the drawings, as the thickness t1 of the insulator layer 120 of the oscillation film 12 is reduced, the effects of reducing the capacitance by forming the oscillation film sandwich portion 20 using an insulator material are increased. As the thickness t2 of the oscillation film sandwich portion 20 is increased, the effects of reducing the capacitance are also increased.

As such, only the power application can be reduced without changing at all the electrostatic force so that the resulting ultrasonic transducer can be better in energy efficiency.

Description about Exemplary Configuration of Superdirective Acoustic System of Invention Described next is a superdirective acoustic system using an ultrasonic speaker configured by the electrostatic ultrasonic transducer of the invention, i.e., the electrostatic ultrasonic transducer of Push-Pull type in which the fixed electrodes each have the thickness t of about $(\lambda/4)\cdot n$ (where λ denotes a wavelength of ultrasound, and n denotes a positive odd number) or $(\lambda/4)\cdot n-\lambda/8 \leqq t \leqq (\lambda/4)\cdot n+\lambda/8$ (where λ denotes a wavelength of ultrasound, and n denotes a positive odd number), and the portions formed with the through holes each configure a resonance tube.

For description, exemplified is a projector as a superdirective acoustic system of the invention. Note here that the superdirective acoustic system of the invention is surely not restrictive to a projector, and can be widely applied to a display device in charge of audio and video reproduction.

FIG. 12 shows the state in which a projector of the invention is used. As is shown in the drawing, a projector 301 is disposed behind a viewer 303, and projects videos onto a screen 302, which is disposed before the viewer 303. By an ultrasonic speaker equipped to the projector 301, a virtual sound source is formed on the projection surface of the screen 302 so that the audio is reproduced.

Figure 13A:
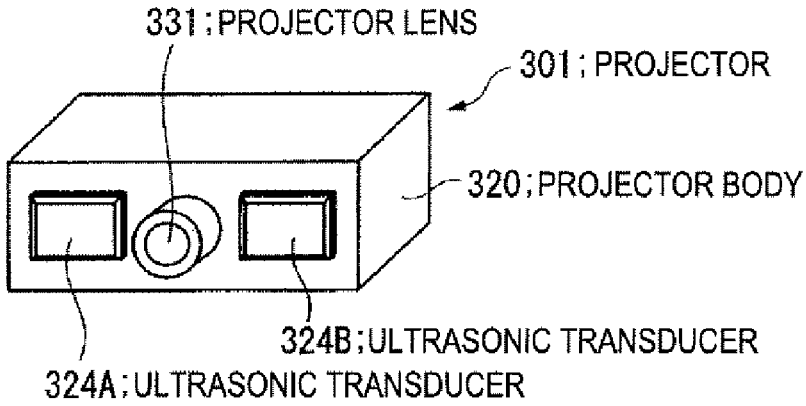
FIGS. 13A and 13B are each a diagram showing the outer configuration of the projector of FIG. 12.
Figure 13B:
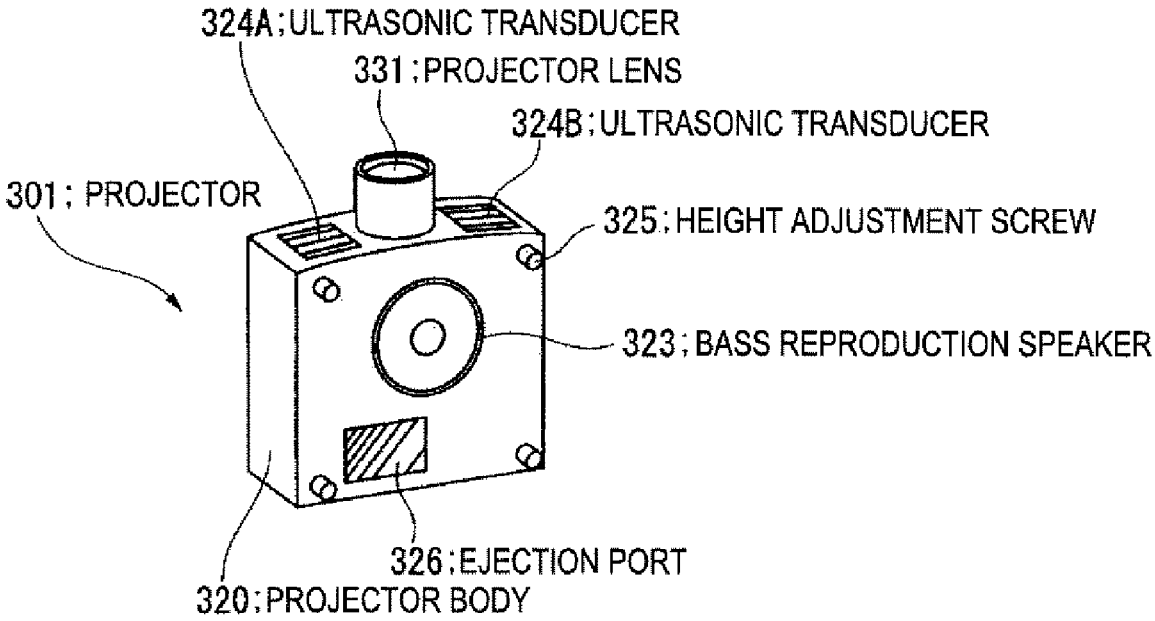

FIGS. 13A and 13B each show the outer configuration of the projector 301. The projector 301 is configured to include a projector body 320, and ultrasonic transducers 324A and 324B. The projector body 320 includes a projection system that projects videos on the projection surface of a screen or others, and the ultrasonic transducers 324A and 324B are capable of oscillating acoustic waves in the ultrasonic frequency band. The projector 301 is configured to be a piece with an ultrasonic speaker, which reproduces signal sounds in an audio frequency band from audio signals coming from an acoustic source. In this embodiment, to reproduce stereo audio signals, the projector body is equipped with the ultrasonic transducers 324A and 324B configuring ultrasonic speakers, which interpose a projector lens 331 therebetween in the horizontal direction, configuring the projection system.

On the bottom surface of the projector body 320, a bass reproduction speaker 323 is provided. In the drawing, a reference numeral 325 denotes a height adjustment screw for adjusting the projector body 320 by height, and a reference numeral 326 denotes an ejection port for an air cooling fan.

As the ultrasonic transducer configuring an ultrasonic speaker, the projector 301 is using the electrostatic ultrasonic transducer of Push-Pull type of the invention, i.e., electrostatic ultrasonic transducer in which portions formed with the through holes each configure a resonance tube, so that acoustic signals i.e., acoustic wave of ultrasonic frequency band can be oscillated at the high sound pressure over a wide range of frequency. Accordingly, by controlling the spatial reproduction range for reproduction signals in an audio frequency band through a change made to the frequency of carrier waves, the previously-required large-sized acoustic system is not required any more to derive acoustic effects popular with stereo surround systems, 5.1 ch surround systems, or others, and the resulting projector can be easy to carry around.

Figure 14:
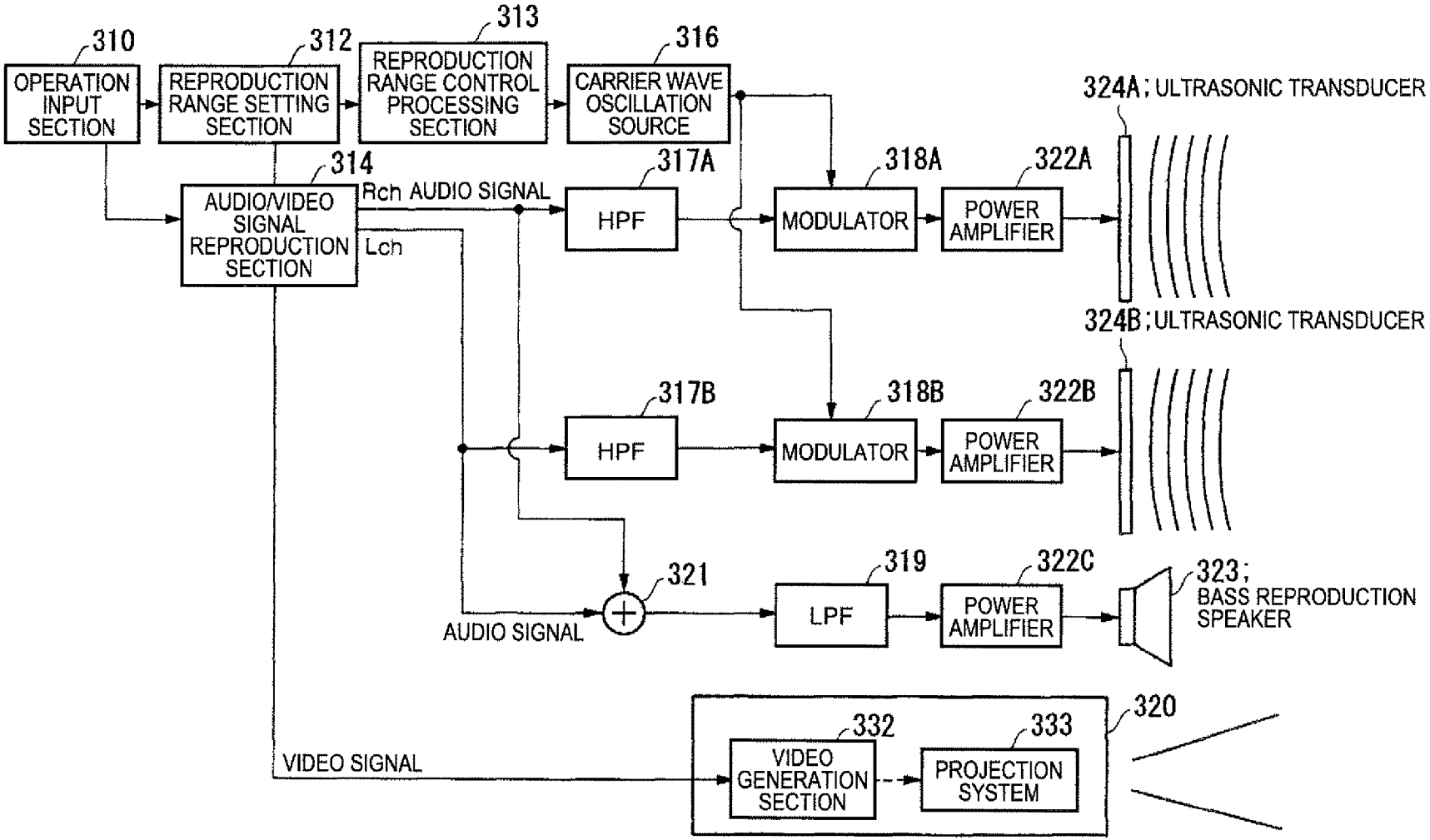
FIG. 14 is a block diagram showing the electronic configuration of the projector of FIG. 12.

FIG. 14 shows the electronic configuration of the projector 301. The projector 301 is configured to include an ultrasonic speaker, high-pass filters 317A and 317B, a low-pass filter 319, an adder 321, a power amplifier 322C, the bass reproduction speaker 323, and the projector body 320. The ultrasonic speaker includes an operation input section 310, a reproduction range setting section 312, a reproduction range control processing section 313, an audio/video signal reproduction section 314, a carrier wave oscillation source 316, modulators 318A and 318B, power amplifiers 322A and 322B, and the electrostatic ultrasonic transducers 324A and 324B. Note here that the electrostatic ultrasonic transducers 324A and 324B are both the electrostatic ultrasonic transducer of Push-Pull type of the invention, i.e., the portions formed with the through holes each configure a resonance tube.

The projector body 320 includes a video generation section 332 that generates a video, and a projection system 333 that projects the generated video on a projection surface. The projector 301 is configured, as a piece, by the ultrasonic speaker, the bass reproduction speaker 323, and the projector body 320.

The operation input section 310 is equipped with various function keys, including a ten-digit keypad, a numeric keypad, and a power key for turning on and off the power. The reproduction range setting section 312 is so configured as to receive data, which is input by a user through key operation of the operation input section 310. The data is defining the reproduction range of a reproduction signal (signal sound). When such data is input, the frequency is set and kept for a carrier wave that defines the reproduction range of the reproduction signal. Such reproduction range setting for the reproduction signal is made by specifying the distance to be covered by the reproduction signal from the acoustic wave emission surfaces of the ultrasonic transducers 324A and 324B in the direction of an emission axis.

With the reproduction range setting section 312, the frequency of the carrier wave can be set by a control signal coming from the audio/video reproduction section 314 depending on the contents of the video.

The reproduction range control processing section 313 serves to exercise control over the carrier wave oscillation source 316 with reference to the setting details of the reproduction range setting section 312. That is, the reproduction range control processing section 313 changes the frequency of a carrier wave to be generated by the carrier wave oscillation source 316 to make the frequency fall into the set reproduction range.

For example, if set with the internal information, i.e., the distance corresponding to the carrier wave frequency of 50 kHz, the reproduction range setting section 312 controls the carrier wave oscillation source 316 to oscillate with 50 kHz.

The reproduction range control processing section 313 is provided with a storage section that previously stores a table showing the relationship between the distance to be covered by a reproduction signal and the frequency of a carrier wave. The reproduction signal is directed, in the direction of an emission axis, from the acoustic wave emission surfaces of the ultrasonic transducers 324A and 324B defining the reproduction range. The data in the table is derived by actually measuring the relationship between the frequency of the carrier wave and the distance to be covered by the reproduction signal.

Based on the details set by the reproduction range setting section 312, the reproduction range control processing section 313 refers to the table to find the frequency of the carrier wave corresponding to the information about the set distance, and exercises control over the carrier wave oscillation source 316 to oscillate with the frequency.

The audio/video signal reproduction section 314 is a DVD (Digital Versatile Disc) player using a DVD as a video medium. From the reproduced audio signal, an R-channel audio signal is output to the modulator 318A via the high-pass filter 317A, an L-channel audio signal is output to the modulator 318B via the high-pass filter 317B, and the video signal is output to the video generation section 332 of the projector body 320.

The R- and L-channel audio signals provided by the audio/video signal reproduction section 314 are combined together by the adder 321, and the combined result is then forwarded to the power amplifier 322C via the low-pass filter 319. The audio/video signal reproduction section 314 is equivalent to the acoustic source.

The high-pass filters 317A and 317B have the characteristics of passing therethrough only frequency components in the mid- to high-frequency ranges of the R- and L-channel audio signals, respectively. The low-pass filter has characteristics of passing only the frequency components in the bass-frequency range in the R- and L-channel audio signals.

Therefore, in the R- and L-channel audio signals, any audio signal in the mid- to high-frequency ranges is reproduced by the ultrasonic transducers 324A and 324B, respectively, and any audio signal in the bass-frequency range is reproduced by the bass reproduction speaker 323.

Note here that the audio/video signal reproduction section 314 is not restrictive to the DVD player, and may be a reproduction device that reproduces video signals coming from the outside. The audio/video signal reproduction section 314 serves to output a control signal toward the reproduction range setting section 312 as a command of specifying the reproduction range. Such a command is aimed to dynamically change the reproduction range for the reproduction sound so that the sound effects can match the scene of a video to be reproduced.

The carrier wave oscillation source 316 serves to generate a carrier wave of the frequency in the ultrasonic frequency band instructed by the reproduction range setting section 312, and output the resulting carrier wave to the modulators 318A and 318B.

The modulators 318A and 318B serve to subject, to AM modulation, the carrier wave provided by the carrier wave oscillation source 316 using an audio signal in an audio frequency band coming from the audio/video signal reproduction section 314, and output the resulting modulation signal to the power amplifiers 322A and 322B.

The ultrasonic transducers 324A and 324B are driven by the modulation signal coming from the modulators 318A and 318B via the power amplifiers 322A and 322B, respectively, and serve to convert the modulation signal into an acoustic wave of a limited amplitude level for emission to a medium. In such a manner, the signal sound in the audio frequency band (reproduction signal) is reproduced.

The video generation section 332 includes a display exemplified by a liquid crystal display, a plasma display panel (PDP), and others, a drive circuit that drives the display based on a video signal coming from the audio/video signal reproduction section 314, and others. The video generation section 332 generates a video from the video signal provided by the audio/video signal reproduction section 314.

The projection system 333 serves to project the video displayed on the display onto the projection surface of a screen or others disposed in the front of the projector body 320.

Described next is the operation of the projector 301 configured as such. First of all, the reproduction range setting section 312 receives data (distance information) provided by the operation input section 310 through user's key operation. The data defines the reproduction range for the reproduction signal. In response to such data setting, a reproduction command is issued to the audio/video signal reproduction section 314.

As a result, the reproduction range setting section 312 is set with the distance information defining the reproduction range. The reproduction range control processing section 313 captures the distance information set to the reproduction range setting section 312, and finds the frequency of a carrier wave corresponding to thus set distance information with reference to the table stored in the internally-provided storage section. Thereafter, the carrier wave oscillation source 316 is so controlled as to generate a carrier wave of the frequency.

The carrier wave oscillation source 316 thus generates a carrier wave of the frequency corresponding to the distance information set to the reproduction range setting section 312, and forwards the resulting carrier wave to the modulators 318A and 318B.

From the reproduced audio signal, the audio/video signal reproduction section 314 outputs an R-channel audio signal to the modulator 318A via the high-pass filter 317A, an L-channel audio signal to the modulator 318B via the high-pass filter 317B, the R-channel audio signal and the L-channel audio signal to the adder 321, and a video signal to the video generation section 332 of the projector body 320.

Accordingly, in the R-channel audio signal, any audio signal in the mid- to high-frequency ranges is forwarded to the modulator 318A via the high-pass filter 317A, and in the L-channel audio signal, any audio signal in the mid- to high-frequency ranges is forwarded to the modulator 318B via the high-pass filter 317B.

The R- and L-channel audio signals are combined together by the adder 321, and via the low-pass filter 319, any bass audio signal in the R- and L-channel audio signals is forwarded to the power amplifier 322C.

The video generation section 332 drives the display based on the incoming video signal, and generates and displays a video. The video displayed on this display is projected by the projection system 333 onto the projection surface, e.g., onto the screen 302 of FIG. 12.

On the other hand, the modulator 318A subjects, to AM modulation, the carrier wave provided by the carrier wave oscillation source 316 using the audio signal in the mid- to high-frequency ranges extracted from the P-channel audio signal provided by the high-pass filter 317A. The resulting carrier wave is output to the power amplifier 322A.

The modulator 318B subjects, to AM modulation, the carrier wave provided by the carrier wave oscillation source 316 using the audio signal in the mid- to high-frequency ranges extracted from the L-channel audio signal provided by the high-pass filter 317B. The resulting carrier wave is output to the power amplifier 322B.

The modulation signals through with amplification by the power amplifiers 322A and 322B are applied between the upper and lower electrodes 10A and 10B (refer to FIG. 1A) of the ultrasonic transducers 324A and 324B, respectively. The modulation signals are then converted into acoustic waves (acoustic signals) of a limited amplitude level, and are emitted into a medium (into the air). From the ultrasonic transducer 324A, the audio signal in the mid- to high-frequency ranges is reproduced from the R-channel audio signal, and from the ultrasonic transducer 324B, the audio signal in the mid- to high-frequency ranges is reproduced from the L-channel audio signal.

The audio signal in the bass-frequency range extracted from the R- and L-channel audio signals is reproduced by the bass reproduction speaker 323 after being amplified by the power amplifier 322C.

As described in the foregoing, in the course of transmission, the ultrasound emitted into a medium (into the air) by the ultrasonic transducer is affected by the difference of sound pressure. This causes an increase of the speed of sound in the portion of high sound pressure, and a decrease in the portion of low sound pressure. As a result, the waveforms are distorted.

When the signal in the ultrasonic frequency band (carrier wave) is subjected to modulation (AM modulation) using a signal in an audio frequency band before emission, due to the waveform distortion, the signal wave in the audio frequency band used for modulation is separated from the carrier wave in the ultrasonic frequency band, and is self-demodulated. At such a time, the reproduction signal is spread in beam due to the characteristics of the ultrasound, and the audio is reproduced only in the specific direction totally different from that of the normal speaker.

The reproduction signal coming, in beam, from the ultrasonic transducer 324 configuring an ultrasonic speaker is emitted toward the projection surface (screen) on which the video is projected by the projection system 333. The signal is then spread after being reflected by the projection surface. With this being the case, depending on the frequency of a carrier wave set to the reproduction range setting section 312, the reproduction range changes because the distance to be covered until a reproduction signal is separated from a carrier wave varies, and the beam width of the carrier wave, i.e., the divergence angle of beam, also varies. Here, the distance to be covered until a reproduction signal is separated from a carrier wave is directed from the acoustic wave emission surface of the ultrasonic transducer 324 in the direction of an emission axis, i.e., direction of the normal.

Figure 15:
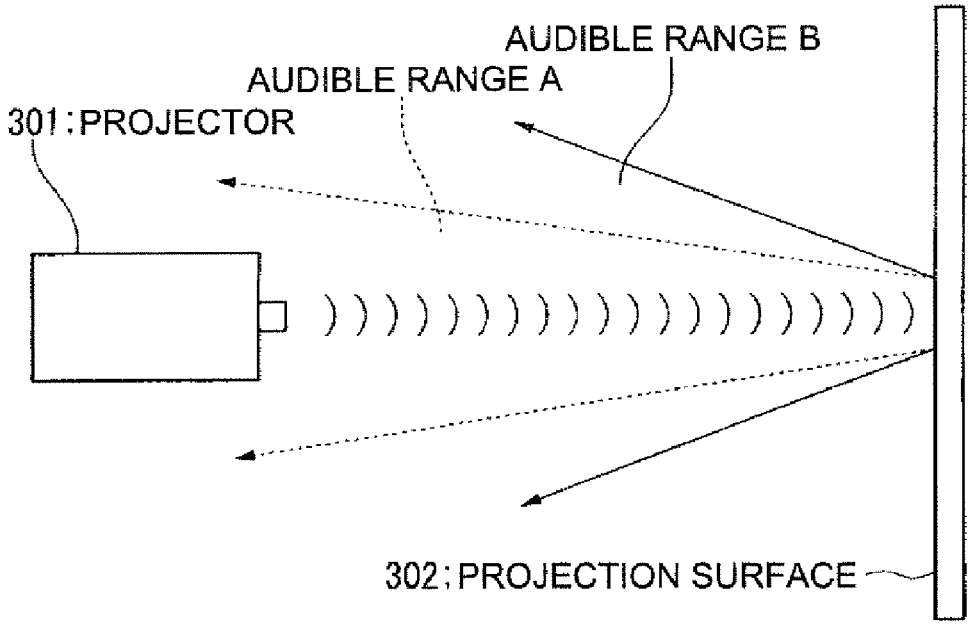
FIG. 15 is a diagram for illustrating the reproduction state for a reproduction signal by the ultrasonic transducer.
Figure 16:
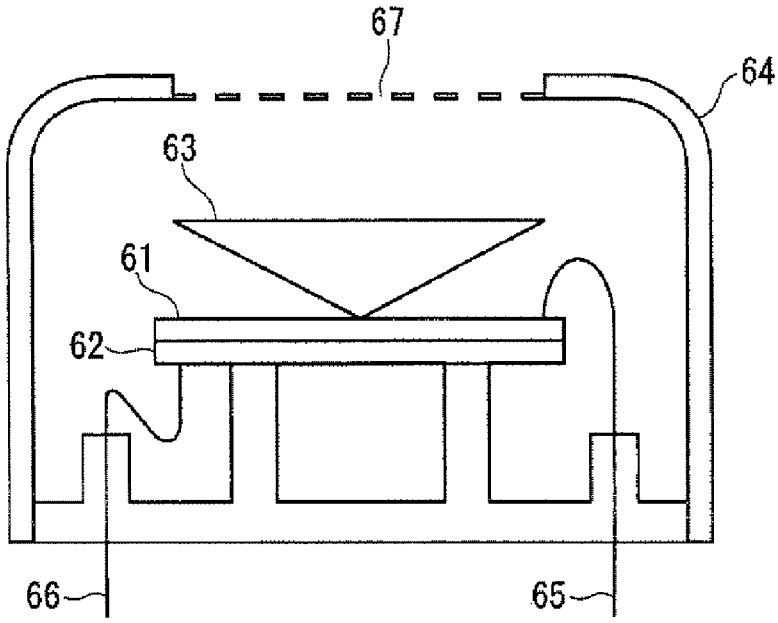
FIG. 16 is a diagram showing the configuration of a previous ultrasonic transducer of resonance type.
Figure 17:
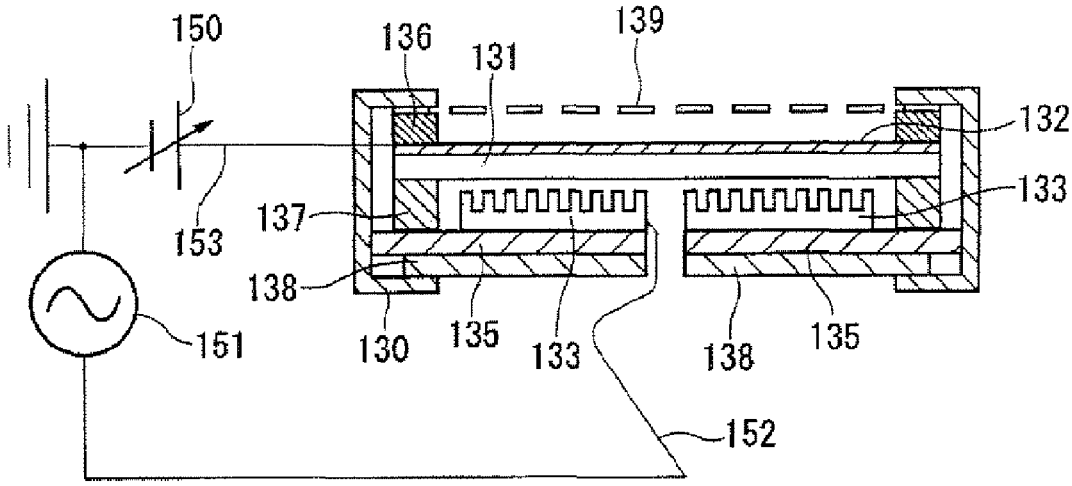
FIG. 17 is a diagram showing the specific configuration of a previous broadband oscillation ultrasonic transducer of electrostatic type.

FIG. 15 shows the state in which a reproduction signal is reproduced by an ultrasonic speaker, which is configured by including the ultrasonic transducers 324A and 324B in the projector 301. In the projector 301, to drive the ultrasonic transducer by the modulation signal derived by modulating a carrier wave using a sound signal, when the carrier frequency set by the reproduction range setting section 312 is low, the distance to be covered until a reproduction signal is separated from a carrier wave, i.e., distance to a point of reproduction, is lengthened. The distance is directed from the acoustic wave emission surface of the ultrasonic transducer 324 in the direction of an emission axis, i.e., direction of the normal of the acoustic wave emission surface.

Accordingly, the beam of the reproduced reproduction signal in the audio frequency band reaches the projection surface (screen) 302 with a relatively narrow divergence angle. Because the beam is reflected by the projection surface 302 in this state, the reproduction range is an audible range A in FIG. 15 indicated by a dotted arrow. Accordingly, the reproduction signal (reproduced audio) sounds only in a range being relatively far but narrow from the projection surface 302.

On the other hand, when the carrier frequency set by the reproduction range setting section 312 is higher than the case described above, the acoustic wave emitted from the acoustic wave emission surface of the ultrasonic transducer 324 is narrower in range than the case with the low carrier frequency. The distance to be covered until a reproduction signal is separated from a carrier wave, i.e., distance to a point of reproduction, is shortened in the direction from the acoustic emission surface of the ultrasonic transducer 324 toward an emission axis (direction of the normal of the acoustic wave emission surface).

Accordingly, before reaching the projection surface 302, the beam of the reproduced reproduction signal in the audio frequency band diverges, and then reaches the projection surface 302. Because the beam is reflected by the projection surface 302 in this state, the reproduction range is an audible range B in FIG. 15 indicated by a solid arrow. Accordingly, the reproduction signal (reproduced audio) sounds only in a range being relatively close but wide from the projection surface 302.

As described in the foregoing, with the projector of the invention, used is an ultrasonic speaker with an electrostatic ultrasonic transducer of Push-Pull type, i.e., an electrostatic ultrasonic transducer in which portions formed with through holes portion each configure a resonance tube. Therewith, an acoustic signal can be reproduced with a sufficient level of sound pressure and the broadband characteristics from a virtual sound source formed in the vicinity of an acoustic wave reflector surface exemplified by a screen. Accordingly, the reproduction range can be also controlled with ease.

The ultrasonic transducer according to the embodiments of the invention is applicable to various types of sensors, e.g., distance measuring sensor. As described above, the ultrasonic transducer is also applicable to a sound source for a directive speaker, a generation source of any ideal impulse signal, and others. Other applicable possibilities include a superdirective acoustic system, and a display device such as projector, for example.

The entire disclosure of Japanese Patent Application Nos: 2005-225068, filed Aug. 3, 2005 and 2006-163241, filed Jun. 13, 2006 are expressly incorporated by reference herein.

What is claimed is:

1. An ultrasonic speaker, comprising:

an electrostatic ultrasonic transducer including:

a first electrode that is formed with a plurality of holes;

a second electrode that is formed with a plurality of holes, and forms a pair of electrodes with the first electrode;

an oscillation film formed with a conductor layer that is sandwiched between the pair of electrodes, and the conductor layer receiving a direct-current bias voltage; and a retention member that retains the pair of electrodes and the oscillation film, wherein an alternating signal is applied between the pair of electrodes, and the pair of electrodes each have a thickness t of $(\lambda/4)\cdot n-\lambda/8 \leqq t \leqq (\lambda/4)\cdot n+\lambda/8$, where $\lambda$ denotes a wavelength of ultrasound, and n denotes a positive odd number);

a signal source that generates a signal wave in an audio frequency band;

a carrier wave supply unit that generates and outputs a carrier wave in an ultrasonic frequency band; and a modulation unit that modulates the carrier wave by the signal wave in the audio frequency band provided by the signal source, wherein the electrostatic ultrasonic transducer is driven by a modulation signal that is applied between the pair of electrodes and electrode layers formed to the oscillation film, and is provided by the modulation unit.

2. The ultrasonic speaker according to claim 1, wherein each of the holes of the pair of electrodes is formed as a cylindrical through hole.

3. The ultrasonic speaker according to claim 1, wherein each of the holes of the pair of electrodes is a through hole having at least two coupled concentric cylindrical holes varying in diameter and depth.

4. The ultrasonic speaker according to claim 1, wherein each of the holes of the pair of electrodes has a tapered cross section.

5. The ultrasonic speaker according to claim 1, wherein each of the holes of the pair of electrodes is a through hole having a rectangular plane surface.

6. The ultrasonic speaker according to claim 1, wherein each of the holes of the pair of electrodes is a through hole formed on a center line of each of the electrodes, and has at least two coupled rectangular holes of the same length but different diameter and depth.

7. The ultrasonic speaker according to claim 5, wherein each of the through holes of the pair of electrodes has a tapered cross section.

8. The ultrasonic speaker according to claim 3, wherein the two coupled concentric cylindrical holes includes a first hole and a second hole, the first hole being nearer the oscillation film than the second hole, the first hole having a larger hole diameter and a shallower depth than the second hole.

9. The ultrasonic speaker according to claim 6, wherein the two coupled rectangular holes includes a first hole and a second hole, the first hole being nearer the oscillation film than the second hole, the first hole having a larger width and a shallower depth than the second hole.

10. The ultrasonic speaker according to claim 2, wherein the holes are the same size.

11. The ultrasonic speaker according to claim 2, wherein the holes vary in size; and opposing holes have the same size.

12. The ultrasonic speaker according to claim 2, wherein each of the pair of electrodes comprises a single piece of a conductor member.

13. The ultrasonic speaker according to claim 2, wherein each of the pair of electrodes comprises a plurality of conductor members.

14. The ultrasonic speaker according to claim 2, wherein each of the pair of electrodes comprises a conductor member and an insulator member.

15. The ultrasonic speaker according to claim 1, wherein the oscillation film includes an electrode layer on both surfaces of an insulator polymer film.

16. The ultrasonic speaker according to claim 1, wherein the oscillation film includes an electrode layer sandwiched between two insulator polymer films.

17. The ultrasonic speaker according to claim 16, wherein the two insulator polymer films are attached to each other.

18. The ultrasonic speaker according to claim 11, wherein the oscillation film is an electret film.

* * * * *